US010543705B2

(12) United States Patent
Ohnishi et al.

(10) Patent No.: US 10,543,705 B2
(45) Date of Patent: Jan. 28, 2020

(54) INK JET RECORDING METHOD USING POROUS BODY

(71) Applicant: CANON KABUSHIKI KAISHA, Tokyo (JP)

(72) Inventors: Toru Ohnishi, Yokohama (JP); Toru Yamane, Yokohama (JP); Akihiro Mouri, Fuchu (JP); Ryosuke Hirokawa, Kawasaki (JP); Noboru Toyama, Kawasaki (JP); Kyosuke Deguchi, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/022,223

(22) Filed: Jun. 28, 2018

(65) Prior Publication Data

US 2018/0319189 A1 Nov. 8, 2018

Related U.S. Application Data

(63) Continuation of application No. PCT/JP2016/005248, filed on Dec. 28, 2016.

(30) Foreign Application Priority Data

Jan. 5, 2016 (JP) ..... 2016-000746
Jan. 29, 2016 (JP) ..... 2016-016272
(Continued)

(51) Int. Cl.
*B41M 5/00* (2006.01)
*B41J 2/21* (2006.01)

(52) U.S. Cl.
CPC ..... *B41M 5/0017* (2013.01); *B41J 2/2103* (2013.01)

(58) Field of Classification Search
CPC .... B41M 5/0017; B41M 7/0018; B41M 7/00; B41J 11/0015; B41J 2/2103; B41J 2/01;
(Continued)

(56) References Cited

U.S. PATENT DOCUMENTS 3,953,566 A 4/1976 Gore
3,962,153 A 6/1976 Gore
(Continued)

FOREIGN PATENT DOCUMENTS

CN 1990241 A 7/2007
CN 101332708 A 12/2008
(Continued)

OTHER PUBLICATIONS

Ohnishi et al., U.S. Appl. No. 16/018,182, filed Jun. 26, 2018.
(Continued)

*Primary Examiner* — Henok D Legesse
(74) *Attorney, Agent, or Firm* — Venable LLP

(57) ABSTRACT

In an ink jet recording method including a step of absorbing a liquid component from an image formed of ink and a reaction liquid by a porous body of a liquid absorbing member, a resin fine particle agglomerated by the reaction liquid are contained in the ink, and a particle diameter d50 of a solid content contained in a mixture of the ink after agglomeration and the reaction liquid is larger than an average pore diameter of a porous membrane of the liquid absorbing member, and thereby adhesion of a coloring material to the porous body can be suppressed.

19 Claims, 5 Drawing Sheets

(30) Foreign Application Priority Data

May 26, 2016 (JP) ..... 2016-105334
May 27, 2016 (JP) ..... 2016-106189
May 30, 2016 (JP) ..... 2016-107965

(58) Field of Classification Search
CPC ... B41J 2002/012; B41F 31/007; B41F 31/24; B41L 25/10; B41L 27/26
See application file for complete search history.

(56) References Cited

U.S. PATENT DOCUMENTS

| | | | | |
|---|---|---|---|---|
| 4,096,227 | A | 6/1978 | Gore | |
| 4,187,390 | A | 2/1980 | Gore | |
| 5,841,456 | A | 11/1998 | Takei et al. | |
| 6,916,081 | B2 | 7/2005 | Nakashima | |
| 7,129,284 | B2 | 10/2006 | Ma et al. | |
| 7,422,318 | B2 | 9/2008 | Kadomatsu et al. | |
| 7,481,526 | B2 | 1/2009 | Inoue | |
| 7,497,564 | B2 | 3/2009 | Yui | |
| 7,556,342 | B2 | 7/2009 | Hamano | |
| 7,594,722 | B2 | 9/2009 | Kadomatsu et al. | |
| 7,766,457 | B2 | 8/2010 | Chen | |
| 7,845,760 | B2 | 12/2010 | Hirakawa | |
| 7,926,933 | B2 | 4/2011 | Taniuchi et al. | |
| 8,226,225 | B2 | 7/2012 | Yamanobe | |
| 8,246,158 | B2 | 8/2012 | Ageishi et al. | |
| 8,857,962 | B2 | 10/2014 | Goto et al. | |
| 9,102,137 | B2 | 8/2015 | Koitabashi et al. | |
| 9,616,653 | B2 | 4/2017 | Liu | |
| 9,796,171 | B2 | 10/2017 | Liu | |
| 9,821,584 | B2 | 11/2017 | Noguchi et al. | |
| 10,029,481 | B2 | 7/2018 | Ohnishi et al. | |
| 2006/0061642 | A1* | 3/2006 | Ueki | B41M 7/00 347/101 |
| 2006/0221166 | A1 | 10/2006 | Inoue | |
| 2007/0229586 | A1 | 10/2007 | Hirakawa | |
| 2008/0006176 | A1 | 1/2008 | Houjou | |
| 2008/0055356 | A1* | 3/2008 | Yamanobe | B41J 2/0057 347/21 |
| 2008/0236480 | A1 | 10/2008 | Furukawa et al. | |
| 2009/0079784 | A1* | 3/2009 | Chiwata | B41J 2/2114 347/21 |
| 2011/0069109 | A1 | 3/2011 | Tojo | |
| 2015/0306539 | A1 | 10/2015 | Yamato | |
| 2018/0297377 | A1 | 10/2018 | Ohnishi et al. | |
| 2018/0304616 | A1 | 10/2018 | Honda et al. | |
| 2018/0304617 | A1 | 10/2018 | Ohnishi et al. | |
| 2018/0311951 | A1 | 11/2018 | Sakamoto et al. | |
| 2018/0319166 | A1 | 11/2018 | Yamane et al. | |
| 2018/0319179 | A1 | 11/2018 | Yamane et al. | |
| 2018/0319188 | A1 | 11/2018 | Toyama et al. | |
| 2018/0319190 | A1 | 11/2018 | Hirokawa et al. | |
| 2018/0326719 | A1 | 11/2018 | Masuda et al. | |
| 2018/0326755 | A1 | 11/2018 | Ohnishi et al. | |

FOREIGN PATENT DOCUMENTS

| | | | |
|---|---|---|---|
| CN | 100546832 | C | 10/2009 |
| CN | 101607468 | A | 12/2009 |
| CN | 103660656 | A | 3/2014 |
| EP | 2 123 459 | A2 | 11/2009 |
| EP | 2 777 941 | A1 | 9/2014 |
| JP | 56-45773 | B2 | 10/1981 |
| JP | 2000-103157 | A | 4/2000 |
| JP | 2001-171143 | A | 6/2001 |
| JP | 2001-179959 | A | 7/2001 |
| JP | 2004-43047 | A | 2/2004 |
| JP | 2004-181955 | A | 7/2004 |
| JP | 2005-161610 | A | 6/2005 |
| JP | 2006-82428 | A | 3/2006 |
| JP | 2006-088486 | A | 4/2006 |
| JP | 2006-102981 | A | 4/2006 |
| JP | 2006-205677 | A | 8/2006 |
| JP | 2006-264080 | A | 10/2006 |
| JP | 2007-268974 | A | 10/2007 |
| JP | 2007-268975 | A | 10/2007 |
| JP | 4016559 | B2 | 12/2007 |
| JP | 2008-55852 | A | 3/2008 |
| JP | 2008-087283 | A | 4/2008 |
| JP | 2008-213333 | A | 9/2008 |
| JP | 2008-246787 | A | 10/2008 |
| JP | 2009-915 | A | 1/2009 |
| JP | 2009-000916 | A | 1/2009 |
| JP | 2009-045851 | A | 3/2009 |
| JP | 2009-61644 | A | 3/2009 |
| JP | 2009-072927 | A | 4/2009 |
| JP | 2009-086348 | A | 4/2009 |
| JP | 2009-159116 | A | 7/2009 |
| JP | 2009-166387 | A | 7/2009 |
| JP | 2009-214439 | A | 9/2009 |
| JP | 2009-226852 | A | 10/2009 |
| JP | 2009-234219 | A | 10/2009 |
| JP | 2010-201796 | A | 9/2010 |
| JP | 2011-63001 | A | 3/2011 |
| JP | 2011-245865 | A | 12/2011 |
| JP | 2012-116617 | A | 6/2012 |
| JP | 2012-183798 | A | 9/2012 |
| JP | 5085893 | B2 | 11/2012 |
| JP | 2013-10267 | A | 1/2013 |
| JP | 2014-193599 | A | 10/2014 |
| JP | 2015-16687 | A | 1/2015 |
| JP | 2015-96562 | A | 5/2015 |
| JP | 2015-098097 | A | 5/2015 |
| JP | 2015-145117 | A | 8/2015 |
| JP | 2015-150789 | A | 8/2015 |
| JP | 2015-208881 | A | 11/2015 |
| JP | 2016-120625 | A | 7/2016 |
| WO | 2015/034027 | A1 | 3/2015 |
| WO | 2017/119044 | A1 | 7/2017 |
| WO | 2017/119045 | A1 | 7/2017 |
| WO | 2017/119046 | A1 | 7/2017 |
| WO | 2017/119047 | A1 | 7/2017 |
| WO | 2017/119049 | A1 | 7/2017 |
| WO | 2018/105215 | A1 | 6/2018 |

OTHER PUBLICATIONS

Toyama et al., U.S. Appl. No. 16/022,118, filed Jun. 28, 2018.
Yamane et al., U.S. Appl. No. 16/022,143, filed Jun. 28, 2018.
Honda et al., U.S. Appl. No. 16/022,169, filed Jun. 28, 2018.
Ohnishi et al., U.S. Appl. No. 16/022,189, filed Jun. 28, 2018.
Ohnishi et al., U.S. Appl. No. 16/013,276, filed Jun. 20, 2018.
Hirokawa et al., U.S. Appl. No. 16/015,734, filed Jun. 22, 2018.
Torisaka et al., U.S. Appl. No. 16/019,905, filed Jun. 27, 2018.
U.S. Appl. No. 16/022,118, WO 2017/119044 A1.
U.S. Appl. No. 16/022,143, WO 2017/119045 A1.
U.S. Appl. No. 16/022,169, WO 2017/119047 A1.
U.S. Appl. No. 16/022,189, WO 2017/119049 A1.
International Search Report in International Application No. PCT/JP2016/005248 (dated Mar. 2017).
Search Report and Written Opinion in Singapore Application No. 11201805829P (dated Sep. 17, 2018).
International Preliminary Report on Patentability in International Application No. PCT/JP2016/005248 (dated Jul. 2018).
Extended European Search Report in European Application No. 16883554.4 (dated Jul. 11, 2019).
Extended European Search Report in European Application No. 16883550.2 (dated Jul. 12, 2019).
Extended European Search Report in European Application No. 16883551.0 (dated Jul. 12, 2019).
Extended European Search Report in European Application No. 16883553.6 (dated Jul. 12, 2019).
Machine translation of JP 2008-213333 (Sep. 18, 2008).
Machine translation of JP 2009-061644 (Mar. 26, 2009).
Machine translation of JP 2015-098097 (May 28, 2015).
Machine translation of JP 2015-145117 (Aug. 13, 2015).
Extended European Search Report in European Application No. 16883546.0 (dated Jul. 23, 2019).
Extended European Search Report in European Application No. 16883549.4 (dated Jul. 23, 2019).

(56) References Cited

OTHER PUBLICATIONS

First Office Action in Chinese Application No. 201680078027.X (dated Apr. 25, 2019).
First Office Action in Chinese Application No. 201680078100.3 (dated Apr. 25, 2019).
First Office Action in Chinese Application No. 201680078028.4 (dated Apr. 28, 2019).
First Office Action in Chinese Application No. 201680078084.8 (dated May 24, 2019).

* cited by examiner

INK JET RECORDING METHOD USING POROUS BODY

CROSS-REFERENCE TO RELATED APPLICATIONS

This application is a continuation of International Application No. PCT/JP2016/005248, filed Dec. 28, 2016, which claims the benefit of Japanese Patent Application Nos. 2016-000746, filed Jan. 5, 2016, 2016-016272, filed Jan. 29, 2016, 2016-105334, filed May 26, 2016, 2016-106189, filed May 27, 2016, and 2016-107965, filed May 30, 2016, all of which are hereby incorporated by reference herein in their entirety.

BACKGROUND OF THE INVENTION

Field of the Invention

The present invention relates to an ink jet recording method.

Description of the Related Art

During image recording by an ink jet method, bleeding in which adjacently applied inks are mixed with each other or beading in which the previously landed ink is attracted to the ink landed later may occur. In addition, curling and cockling may occur due to the recording medium excessively absorbing a liquid component in the ink.

As a method for solving such a problem, there are the following methods.

- A method of reducing degradation of image quality by drying a recording medium using means such as hot air or infrared rays.
- A method of forming an image on a transfer body, then removing a liquid component contained in the image on the transfer body by thermal energy, and then transferring the image onto a recording medium such as paper.

Furthermore, as means for removing the liquid component contained in the image on the transfer body, a method of absorbing the liquid component from the ink on the transfer body so as to remove the liquid component from the ink by using a porous body or a permeable membrane as a liquid absorbing member without using the thermal energy has been proposed (Japanese Patent No. 5085893 and Japanese Patent Application Laid-Open No. 2005-161610).

As a result of the investigation by the inventors of the present invention, in the technique disclosed in Japanese Patent No. 5085893, it was found that in a case where an average pore diameter of a porous body of a liquid absorbing member is larger than a particle diameter d50 of a solid content contained in an agglomerate generated by mixing ink and a reaction liquid, adhesion of a coloring material to the porous body was likely to occur. The occurrence of adhesion of the coloring material is presumed to be because agglomerates easily enter the porous body of the liquid absorbing member.

In addition, in the technique disclosed in Japanese Patent Application Laid-Open No. 2005-161610, it was found that in a case where a resin fine particle agglomerated by the reaction liquid is not contained in the ink, there is a problem in that the adhesion of the coloring material to the permeable membrane occurs. It is presumed that the adhesion of the coloring material occurs because an agglomerate of the ink and the reaction liquid has an insufficient cohesive force and thus the agglomerates easily enter the liquid absorbing member.

An object of the present invention is to provide an ink jet recording method which is capable of removing a liquid component from an image by bringing a porous body into contact with the image, and suppressing adhesion of a coloring material forming the image to the porous body

SUMMARY OF THE INVENTION

According to an aspect of the present invention, there is provided an ink jet recording method including:

- an image forming step of applying to an ink receiving medium an ink which contains a coloring material and a resin fine particle, and a reaction liquid which agglomerates the coloring material and the resin fine particle to thereby form a first image including a liquid component, and an agglomerate of the coloring material and the resin fine particle on the ink receiving medium; and
- a liquid absorbing step of bringing a first surface of a porous body of a liquid absorbing member into contact with the first image on the ink receiving medium to thereby absorb at least a portion of the liquid component from the first image, wherein an average pore diameter S of the first surface of the porous body is smaller than an average particle diameter d50 (after) of a solid content contained in a mixture of the reaction liquid and the ink.

In addition, according to another aspect of the present invention, there is provided an ink jet recording method including:

- an image forming step of applying to an ink receiving medium an ink which contains a coloring material and a resin fine particle, and a reaction liquid which agglomerates the coloring material and the resin fine particle to thereby form a first image including a liquid component, and an agglomerate of the coloring material and the resin fine particle on the ink receiving medium; and
- a liquid absorbing step of bringing a first surface of a porous body of a liquid absorbing member into contact with the first image on the ink receiving medium to thereby concentrate the ink constituting the first image,
- wherein an average pore diameter S of the first surface of the porous body is smaller than an average particle diameter d50 (after) of a solid content contained in a mixture of the reaction liquid and the ink.

Further features of the present invention will become apparent from the following description of exemplary embodiments with reference to the attached drawings.

DESCRIPTION OF THE EMBODIMENTS

Figure 1:
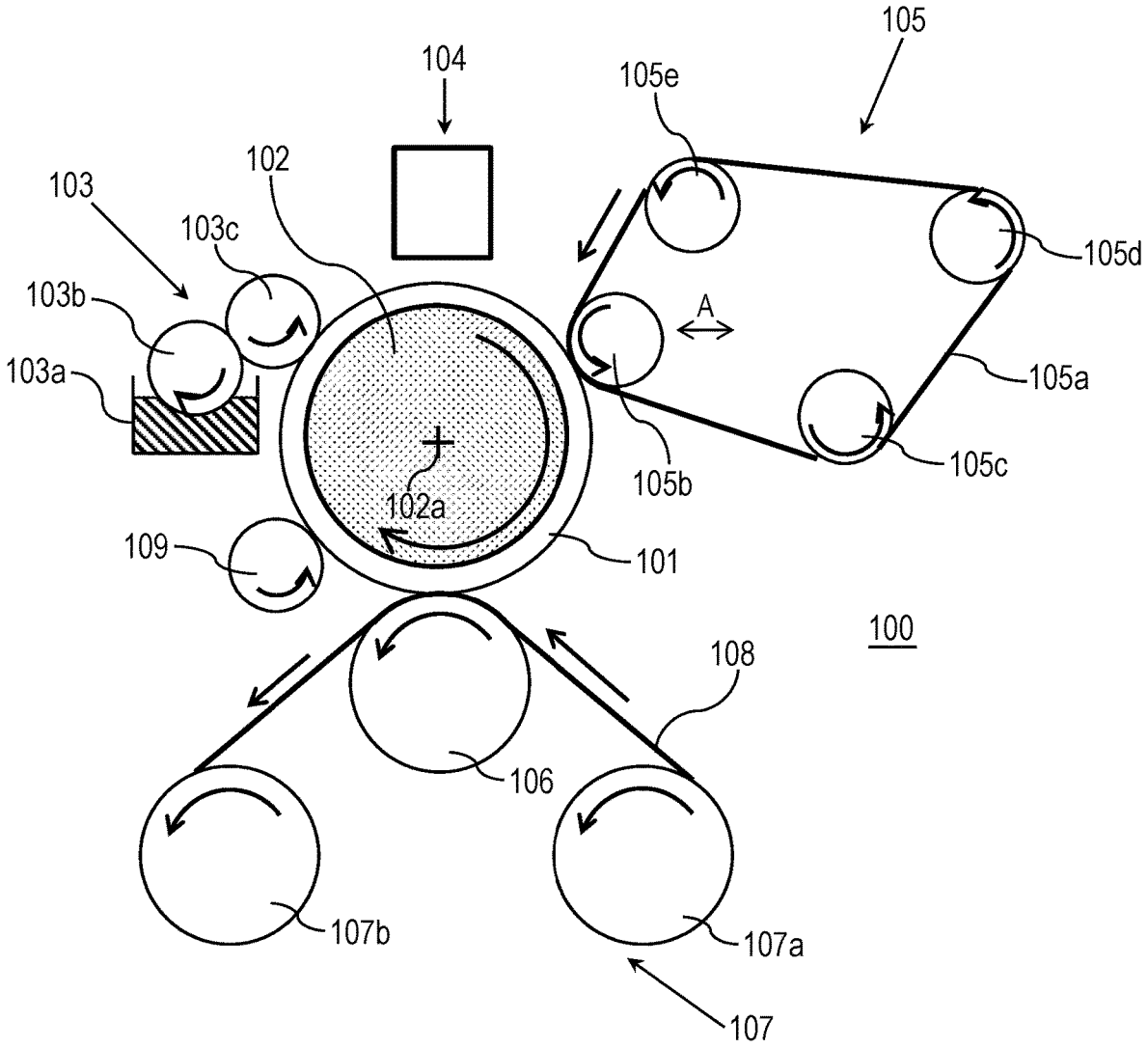
FIG. 1 is a schematic diagram illustrating one example of a configuration of a transfer type ink jet recording apparatus according to the present invention.

Preferred embodiments of the present invention will now be described in detail in accordance with the accompanying drawings.

An ink jet recording method according to the present invention includes the following steps.

(1) An image forming step of applying to an ink receiving medium an ink which contains a coloring material and a resin fine particle, and a reaction liquid which agglomerates the coloring material and the resin fine particle to thereby form a first image including a liquid component, and an agglomerate of the coloring material and the resin fine particle on the ink receiving medium.

(2) A liquid absorbing step of bringing a first surface of a porous body of a liquid absorbing member into contact with the first image on the ink receiving medium to thereby absorb at least a portion of the liquid component from the first image.

Applying the ink to the ink receiving medium in the above-described (1) image forming step is performed by an ink jet method. The ink contains the coloring material and the resin fine particle which are agglomerated by the reaction liquid, and the first image includes the agglomerate of the coloring material and the resin fine particle obtained by mixing the ink and the reaction liquid. The agglomerate may contain at least the coloring material and the resin fine particle, and examples thereof include an agglomerate generated by agglomerating the liquid components in addition to the coloring material and the resin fine particle.

The liquid absorbing member includes a porous body having absorbability for the liquid component, and the porous body includes a first surface as a contact surface which is brought into contact with the first image. At least a portion of the liquid component contained in the first image is absorbed into the porous body from the first surface of the porous body.

In the present invention, the average pore diameter S of the first surface of the porous body is set to be smaller than the average particle diameter d50 (after) of the solid contents contained in the first image formed by the ink and the reaction liquid.

When the average pore diameter S of the first surface of the porous body, and the average particle diameter d50 (after) of the solid contents contained in the first image satisfy the above-described relationship, the adhesion of the coloring material to the porous body can be effectively suppressed at the time of absorbing the liquid component from the first image.

Hereinafter, embodiments of the present invention will be described. An ink jet recording apparatus which is applicable to the ink jet recording method of the present invention includes an image forming unit that forms a first image containing a liquid component and a coloring material, and a liquid absorbing unit that is provided with a liquid absorbing member including a porous body absorbing at least a portion of the liquid component from the first image.

The image forming unit includes a reaction liquid applying unit that applies a reaction liquid, and an ink jet recording unit that applies an ink containing a liquid medium and the coloring material.

In the following description, "reaction liquid applying device" as the reaction liquid applying unit, "ink applying device" as the ink jet recording unit, and "liquid absorbing device" as the liquid absorbing unit were respectively used. In addition, the first image is an ink image before liquid removal before being subjected to liquid absorption treatment by the liquid absorbing member. The ink image after liquid removal in which the content of the first liquid is reduced by performing the liquid absorption treatment is referred to as a second image. In the following description, as a pretreatment to the porous body used for the liquid absorbing member, a process of preliminarily wetting the porous body with the wetting liquid will be described.

<Reaction Liquid Applying Device>

The reaction liquid applying device may be any device as long as the reaction liquid can be applied onto the ink receiving medium, and various known devices can be appropriately used. Specifically, examples thereof include a gravure offset roller, an ink jet head, a die coating device (die coater), and a blade coating device (blade coater). The application of the reaction liquid by the reaction liquid applying device may be performed before application of the ink or after application of the ink as long as the reaction liquid on the ink receiving medium can be mixed (reacted) with the ink. The reaction liquid is preferably applied before the application of the ink. When the reaction liquid is applied before the application of the ink, it is also possible to suppress bleeding in which adjacently applied inks are mixed with each other or beading in which the previously landed ink is attracted to the ink landed later during the image recording by the ink jet method.

<Reaction Liquid>

The reaction liquid contains a component that increases the viscosity of the ink (ink viscosity-increasing component). Here, an increase in viscosity of an ink means that a coloring material, a resin, or the like which is a component constituting the ink chemically reacts by contact with an ink viscosity-increasing component, or physically adsorbs the ink viscosity-increasing component so as to increase the particle diameter of the solid content, and as a result, an increase in the viscosity of the ink is observed. The increase in viscosity of an ink includes not only the case where the increase in the ink viscosity is observed, but also a case where a portion of the component constituting the ink such as the coloring material and the resin agglomerates and the viscosity is locally increased.

The ink viscosity-increasing component has an effect of reducing the fluidity of a portion of the component constituting the ink and/or the ink on the ink receiving medium so as to suppress bleeding and beading during the first image formation. In the present invention, the increasing of the viscosity of the ink is also referred to as "viscously thickening the ink". Known materials such as a polyvalent metal ion, organic acid, a cationic polymer, and a porous fine particle can be used as such an ink viscosity-increasing component. Among these, the polyvalent metal ion and the organic acid are particularly preferable. In addition, it is also preferable to include plural kinds of the ink viscosity-increasing components. Note that, the content of the ink viscosity-increasing component in the reaction liquid is preferably equal to or greater than 5% by mass with respect to the total mass of the reaction liquid.

As the ink viscosity-increasing component, at least a component causing agglomeration of the coloring material and the resin fine particle contained in a state of being dispersed in the ink is used. In addition to the component that causes agglomeration of the resin fine particles, a component that agglomerates the component other than the resin fine particle such as the coloring material contained in the ink may be used in combination.

Examples of the polyvalent metal ion include divalent metal ions such as $Ca^{2+}$, $Cu^{2+}$, $Ni^{2+}$, $Mg^{2+}$, $Sr^{2+}$, $Ba^{2+}$ and $Zn^{2+}$, and trivalent metal ions such as $Fe^{3+}$, $Cr^{3+}$, $Y^{3+}$ and $Al^{3+}$.

Examples of the organic acid include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidone carboxylic acid, pyrone carboxylic acid, pyrrole carboxylic acid, furancarboxylic acid, pyridine carboxylic acid, coumaric acid, thiophene carboxylic acid, nicotinic acid, oxysuccinic acid, and dioxsuccinic acid.

The reaction liquid may contain water or an organic solvent of low volatility in an appropriate amount as an aqueous liquid medium. Water used in this case is preferably deionized water by ion exchange or the like. The organic solvent that can be used in the reaction liquid applied to the present invention is not particularly limited, and known organic solvents can be used.

The reaction liquid can be used by appropriately adjusting the surface tension and the viscosity by adding a surfactant or a viscosity modifier. The material to be used is not particularly limited as long as it can coexist with the ink viscosity-increasing component. Specific examples of the surfactant include a fluorine-based surfactant such as acetylene glycol ethylene oxide adduct ("Acetylenol E100" (product name), manufactured by Kawaken Fine Chemicals Co., Ltd.), and perfluoroalkyl ethylene oxide adduct ("Megafac F444" (product name), manufactured by DIC Corporation).

<Ink Applying Device>

An ink jet head is used as an ink applying device for applying ink. As an ink jet head, there are, for example, the following forms.

- A form in which ink is ejected by causing film boiling in the ink by an electro-thermal converter so as to form bubbles
- A form in which ink is ejected by an electro-mechanical converter
- A form in which ink is ejected by using static electricity In the present invention, a known ink jet head can be used. Particularly, from the viewpoint of high-speed and high-density printing, one utilizing an electro-thermal converter is suitably used. Drawing receives an image signal and applies a necessary amount of ink to each position.

An ink applying amount can be expressed by the image density (duty) or the ink thickness; however, in the present invention, an average value obtained by multiplying the mass of each of the ink dots by the number of ink dots to be applied and dividing by the printing area was set as the ink applying amount ($g/m^2$). Note that, from the viewpoint of removing the liquid component in the ink, the maximum ink applying amount in the image region indicates an ink applying amount in an area of at least equal to or larger than 5 $mm^2$ in a region used as information of the ink receiving medium.

The ink jet recording apparatus may include a plurality of ink jet heads for applying various colors of ink onto the ink receiving medium. For example, in a case of forming respective color images using yellow ink, magenta ink, cyan ink, and black ink, the ink jet recording apparatus includes four ink jet heads that eject each of the above four kinds of ink onto a ink receiving medium.

In addition, the ink applying device may include an ink jet head that ejects ink (clear ink) which does not contain a coloring material.

<Ink>

Each component of the ink applied to the present invention will be described.

(Coloring Material)

Examples of the coloring material contained in the ink which is applied to the present invention include the coloring materials which are agglomerated by the reaction liquid. The coloring material preferably contains a pigment. For example, it is preferable to use a pigment or a mixture of a dye and the pigment as a coloring material. The kinds of the pigments which can be used as a coloring material are not particularly limited. Specific examples of the pigment include an inorganic pigment such as carbon black; and an organic pigment such as an azo-based organic pigment, a phthalocyanine-based organic pigment, a quinacridone-based organic pigment, an isoindolinone-based organic pigment, an imidazolone-based organic pigment, a diketopyrrolopyrrole-based organic pigment, and a dioxazine-based organic pigment. These pigments may be used alone or if necessary, two or more kinds thereof may be used in combination.

The kinds of the dyes which can be used as a coloring material are not particularly limited. Specific examples of the dye include direct dyes, acidic dyes, basic dyes, disperse dyes, edible dyes and the like, and dyes having anionic groups can be used. Specific examples of the dye skeleton include an azo skeleton, a triphenylmethane skeleton, a phthalocyanine skeleton, an azaphthalocyanine skeleton, a xanthene skeleton, and an anthrapyridone skeleton.

The content of the pigment in the ink is preferably 0.5% by mass to 15.0% by mass, and is more preferably 1.0% by mass to 10.0% by mass with respect to the total mass of the ink.

The pigment as the coloring material preferably has an average particle diameter of 10 nm to 1,000 nm, and more preferably has an average particle diameter of 50 nm to 500 nm. These pigments may be used alone or if necessary, two or more kinds thereof may be used in combination (Dispersant)

As a dispersant for dispersing the pigment, a known dispersant used for ink jet ink can be used. In the embodiment of the present invention, it is particularly preferable to use a water-soluble dispersant having both a hydrophilic portion and a water repellent portion in the structure thereof. In particular, a pigment dispersant containing a resin obtained by copolymerizing at least a hydrophilic monomer and a water repellent monomer is preferably used. The monomers used here are not particularly limited, and known monomers are preferably used. Specific examples of the water repellent monomer include styrene and other styrene derivatives, alkyl (meth)acrylate, and benzyl (meth)acrylate. Examples of the hydrophilic monomer include acrylic acid, methacrylic acid, and maleic acid.

The acid value of the dispersant is preferably 50 mgKOH/g to 550 mgKOH/g. In addition, a weight average molecular weight of the dispersant is preferably 1,000 to 50,000. Note that, a mass ratio (pigment:dispersant) of the pigment to the dispersant is preferably in a range of 1:0.1 to 1:3.

In the present invention, it is also preferable to use a so-called self-dispersible pigment in which the pigment itself is surface-modified so that it can be dispersed without using a dispersant.

(Resin Fine Particle)

The ink applied to the present invention can contain various fine particles which do not contain coloring materials. Among them, the inventors of the present invention have found that the resin fine particles agglomerated by the reaction liquid are necessary for suppressing the adhesion of the coloring material to the liquid absorbing member in the liquid absorbing step. The cohesive force of the agglomerate of the coloring material and the resin fine particles formed in the mixture of the reaction liquid and the ink is further strengthened by the existence of the resin fine particles. Therefore, the inventors presume that even in a case where this agglomerate comes into contact with the liquid absorbing member, the agglomerate is maintained without being destroyed, so that the adhesion of the coloring material to the liquid absorbing member is suppressed. The materials of the resin fine particles that can be used in the present invention is not particularly limited, and known resins can be appropriately used. Specific examples thereof include a homopolymer such as polyolefin, polystyrene, polyurethane, polyester, polyether, polyurea, polyamide, polyvinyl alcohol, poly (meth)acrylic acid, salts thereof, alkyl poly (meth) acrylate, and polydiene, or a copolymer obtained by polymerizing a combination of a plurality of monomers for producing these homopolymers.

The weight average molecular weight of the resin (Mw) is preferably in a range of 1,000 to 2,000,000. The amount of the resin fine particles in the ink is preferably 1% by mass to 50% by mass, and is more preferably 2% by mass to 40% by mass, with respect to the total mass of the ink.

Further, in the embodiment of the present invention, it is preferable to use the resin fine particle dispersion in which the resin fine particles are dispersed in a liquid. The method of dispersion is not particularly limited, and a so-called self-dispersible type resin fine particle dispersion which is dispersed using a resin obtained by homopolymerizing a monomer having a dissociable group or copolymerizing a plurality of kinds of monomers is suitable. Here, examples of the dissociable group include a carboxyl group, a sulfonic acid group, and a phosphoric acid group, and examples of the monomer having such a dissociable group include acrylic acid and methacrylic acid. In addition, a so-called emulsion dispersion type resin fine particle dispersion in which resin fine particles are dispersed with an emulsifier can likewise be suitably used in the present invention. A known surfactant is preferable as the emulsifier, regardless of low molecular weight and high molecular weight. The surfactant is preferably a nonionic surfactant or a surfactant which has the same electron as that of the resin fine particle.

The resin fine particle dispersion used in the embodiment of the present invention preferably has a dispersed particle diameter of 10 nm to 1,000 nm, and more preferably has a dispersed particle diameter of 50 nm to 500 nm.

In addition, when the resin fine particle dispersion used in the embodiment of the present invention is prepared, it is also preferable to add various additives for stabilization. Examples of such additives include n-hexadecane, dodecyl methacrylate, stearyl methacrylate, chlorobenzene, dodecyl mercaptan, blue dye (bluing agent), and polymethyl methacrylate.

(Curing Component)

In the present invention, it is preferable that a component that is cured by active energy rays is contained in either the reaction liquid or the ink. By curing the component to be cured by the active energy rays before the liquid absorbing step, it is possible to improve the absorption efficiency of the liquid component in the liquid absorbing member. Further, the effect of suppressing adhesion of the coloring material to the liquid absorbing member may be further improved in some cases.

As a component to be cured by being irradiated with the active energy rays used in the present invention, a component that is cured by being irradiated with the active energy rays and increases its insolubility than that of before irradiation is used. As an example, a general ultraviolet curable resin can be used. Many of the ultraviolet curable resins are insoluble in water, but as a material that can be applied to the water-based ink suitably used in the present invention, a material having at least an ethylenically unsaturated bond curable with ultraviolet rays in the structure thereof and having a hydrophilic bonding group is preferable. Examples of the linking group for having hydrophilicity include a hydroxyl group, a carboxyl group, a phosphoric acid group, a sulfonic acid group and salts thereof, an ether bond, and an amide bond.

In addition, the component that is cured by the active energy rays used in the present invention is preferably hydrophilic.

Further, examples of the active energy rays include ultraviolet rays, infrared rays, and electron beams.

In the present invention, it is preferable that a polymerization initiator is contained in either the reaction liquid or the ink.

The polymerization initiator used in the present invention may be any compound as long as it generates radicals by active energy rays.

Further, in order to improve the reaction rate, it is one of extremely preferable embodiments to use a sensitizer having a role of widening the light absorption wavelength in combination.

(Surfactant)

The ink that can be used in the present invention may contain a surfactant. Specific examples of the surfactant include acetylene glycol ethylene oxide adduct (Acetylenol E100 (product name), manufactured by Kawaken Fine Chemicals Co., Ltd.) and the like. The amount of the surfactant in the ink is preferably 0.01% by mass to 5.0% by mass with respect to the total mass of the ink.

As described later in the description of the porous body, the composition of the ink and/or the reaction liquid can be adjusted such that the contact angle of the aqueous liquid component obtained by allowing the reaction liquid to act on the ink to the first surface of the porous body is smaller than 90° or larger than or equal to 90°. Adjustment of the contact angle of this mixture can be performed by selecting the type and addition amount of the surfactant added to the ink and/or the reaction liquid.

(Water and Water-Soluble Organic Solvent)

As the liquid medium of the ink, an aqueous liquid medium containing at least water is preferably used. As the ink containing the aqueous liquid medium, that is, as an aqueous ink, it is possible to use an aqueous pigment ink containing at least a pigment as the coloring material. In a case where the ink contains the aqueous liquid medium, the first image contains an aqueous liquid component, and an agglomerate of a coloring material and the resin fine particles.

The aqueous liquid medium can further contain a water-soluble organic solvent as necessary. Water is preferably deionized water by ion exchange or the like. In addition, the content of the water in the ink is preferably 30% by mass to 97% by mass with respect to the total mass of the ink, and is more preferably 50% by mass to 95% by mass with respect to the total mass of the ink.

Further, the kinds of the water-soluble organic solvent to be used are not particularly limited, and any of known organic solvents can be used. Specific examples thereof include glycerin, diethylene glycol, polyethylene glycol, polypropylene glycol, ethylene glycol, propylene glycol, butylene glycol, triethylene glycol, thiodiglycol, hexylene glycol, ethylene glycol monomethyl ether, diethylene glycol monomethyl ether, 2-pyrrolidone, ethanol, and methanol. Of course, it is also possible to mix and use two or more kinds selected from them.

In addition, the content of the water-soluble organic solvent in the ink is preferably 3% by mass to 70% by mass with respect to the total mass of the ink.

(Other Additives)

In addition to the above components, as necessary, the ink that can be used in the present invention may contain other additives such as a pH adjuster, a rust inhibitor, an antiseptic, a fungicide, an antioxidant, an anti-reduction agent, a water soluble resin and its neutralizing agent, a viscosity modifier, and the like.

<Liquid Absorbing Member>

In the present invention, when at least a portion of the liquid component is absorbed from the first image by being brought into contact with the liquid absorbing member having the porous body, the content of the liquid component in the first image is decreased. The contact surface of the liquid absorbing member with the first image is set as the first surface, and the porous body is disposed on the first surface.

(Porous Body)

Regarding the porous body, in order to suppress the adhesion of the coloring material contained in the ink to the porous body, an average pore diameter S of the first surface of the porous body to be in contact with at least the first image is required to be smaller than the average particle diameter d50 (after) of solid content (that is, the solid content in the first image) contained in the mixture of the reaction liquid and the ink.

Hereinafter, a method of measuring the average particle diameter d50 (after) of the solid contents contained in the mixture of the reaction liquid and the ink will be described.

First, a 10-fold diluted aqueous solution of the reaction liquid and the ink are mixed and stirred for two to five minutes at the same mass ratio (ink/reaction liquid) as the ratio of the ink to the reaction liquid in the range where the largest amount of the ink is applied in the image. For example, in a case where 0.5 $g/m^2$ reaction liquid is given to the ink 10 $g/m^2$ in the image, 10 g of ink and 0.5 g of 10-fold diluted aqueous solution of the reaction liquid are mixed.

Next, the obtained mixture of the ink and the reaction liquid diluted to 1/200 with water is measured after one to ten minutes, and d50 is calculated as a median diameter. The mixing and stirring is performed using a known stirrer at 200 to 500 R.P.M. As a method of measuring the average particle diameter (d50), any of conventionally used methods may be used, for example, a dynamic light scattering method or a sedimentation rate method. Nanotrac 150 (product name, manufactured by MicrotracBEL Corp.) and the like can be exemplified as an example of the measuring apparatus.

In the present invention, when the ink and undiluted reaction liquid were mixed under non-thin film conditions, non-uniform agglomerates were formed in some cases, and thus a 10-fold diluted reaction liquid was used. It is thought that it is possible to simulate a state of agglomeration with a thin film such as an image by making the reaction uniformly using a diluting reaction liquid.

The inventors of the present invention have confirmed that even when the dilution ratio of the reaction liquid was varied from five times to 20 times, the average particle diameter d50 (after) of the solid content contained in the mixture of the reaction liquid and the ink did not substantially change. From this, it is presumed that the average particle diameter d50 (after) of the solid contents contained in the mixture of the reaction liquid and the ink is saturated at a certain constant value because there is a necessary and sufficient amount of the reaction liquid. In addition, it is thought that, since the average pore diameter S of the surface layer of the porous body is smaller than the average particle diameter d50 (after), the entry of the solid content agglomerated including the coloring material into the porous body is suppressed, and the adhesion of the coloring material contained in the agglomerated solid content is suppressed. Note that, the solid content contained in the mixture of the ink and the reaction liquid is substantially an agglomerate of the coloring material and the resin fine particle.

By changing the components of the reaction liquid or by increasing the particle diameter of the resin fine particle contained in the ink before mixing with the reaction liquid, the average particle diameter d50 (after) of the solid content contained in the mixture of the reaction liquid and the ink can be preferably increased.

The particle diameter distribution at the above average particle diameter d50 (after) is not particularly limited, and either one having a wide particle diameter distribution or one having a monodispersed particle diameter may be used.

In addition, in order to more improve the effect of suppressing the adhesion of the coloring material, the average particle diameter d50 (after) of the solid contents is preferably equal to or greater than five times average pore diameter S of the liquid absorbing member.

Further, in order to improve the effect of suppressing the coloring material, the average pore diameter S of the surface layer of the porous body is preferably smaller than the particle diameter d10 (after) of the solid content contained in the mixture of the reaction liquid and the ink.

In the present invention, the average pore diameter S of the surface layer of the porous body means the average diameter, and can be measured by known means such as a mercury intrusion method, a nitrogen adsorption method, and a SEM image observation.

In the present invention, the average pore diameter S of the first surface of the porous body is preferably equal to or smaller than 2 μm or less, and is more preferably equal to or smaller than 0.6 μm.

When the average pore diameter is equal to or smaller than 2 μm, the filtering property is increased and the adhesion of the coloring material to the porous body is suppressed in some cased. The lower limit of the average pore diameter is not particularly limited, and it may be equal to or larger than 0.02 μm, for example.

In addition, in order to uniformly provide high air permeability, it is preferable to reduce the thickness of the porous body. In order not to deteriorate the air permeability, it is preferable that the average pore diameter S of the surface layer of the porous body of the liquid absorbing member is larger than the particle diameter d50 (before) of the solid content contained in the ink. In other words, the average particle diameter d50 (before) of the solid content contained in the ink is preferably smaller than the average pore diameter S of the surface layer of the porous body of the liquid absorbing member.

The reason for this is presumed to be that the unagglomerated ink solid content contained in the mixture of the ink and the reaction liquid after agglomeration causes clogging on the surface of the liquid absorbing member. In a case where the air permeability is deteriorated, a phenomenon (hereinafter referred to as "smeared image") in which the coloring material at the rear end portion of the image is swept occurs. The degradation of the air permeability means that the absorbability of the liquid component of the porous body is also deteriorated. For this reason, as a result of the degradation of the air permeability, it is presumed that the absorbability of the liquid component of the porous body is also deteriorated, and the image containing the liquid component, which could not be absorbed by the porous body, is brought into contact with the porous body, and thereby the smeared image occurs.

The particle diameter d50 (before) of the solid content contained in the ink can be measured by the same method as described above.

In addition, in order to uniformly provide high air permeability, it is preferable to reduce the thickness of the porous body. Air permeability can be indicated by the Gurley value defined in JIS P8117, and the Gurley value is preferably equal to or shorter than 10 seconds. The shape of the porous body is not particularly limited and may be a roller shape or a belt shape.

However, if the porous body is thinned, the capacity necessary for absorbing the liquid component cannot be sufficiently ensured in some cases, so that it is possible to make the porous body into a multilayer structure. Further, in the liquid absorbing member, only a layer being in contact with the image on the transfer body should be the porous body, and a layer which is not in contact with the image on the transfer body may not be the porous body.

The method of preparing the porous body is not particularly limited and any of the conventionally widely used manufacturing methods can be applied. As an example, Japanese Patent No. 1114482 discloses a method of preparing a porous body obtained by biaxially stretching a resin containing polytetrafluoroethylene.

In the present invention, the material for forming the porous body is not particularly limited, and any of a hydrophilic material having a contact angle to water of less than 90° and a water repellent material having a contact angle of equal to or larger than 90° can be used.

In a case of a hydrophilic material, the contact angle to water is more preferably equal to or smaller than 40°. In the case of the hydrophilic material, it has an effect of suctioning the liquid by a capillary force.

Examples of the hydrophilic material include polyolefin (such as polyethylene (PE)), polyurethane, nylon, polyamide, polyester (polyethylene terephthalate (PET) or the like), and polysulfone (PSF).

It is preferable that the porous body has water repellency from the viewpoint of lowering the affinity with the coloring material contained in the first image (that is, increasing the releasability to the coloring material). In the porous body having the water repellency, the contact angle of water is preferably equal to or larger than 90°. As a result of intensive investigation by the inventors of the present invention, it was found that the adhesion of the coloring material of the ink to the porous body can be suppressed by using the porous body having a contact angle of water of equal to or larger than 90°. The term "contact angle" as used in the present specification means an angle obtained by dropping a measurement liquid (water or the like) onto an object (first surface of porous body) and forming a tangent of the surface of the object and the liquid droplet at a portion where the liquid droplet is in contact with the object. Although there are several kinds of measurement techniques, the inventors of the present invention performed the measurement of the contact angle of the first surface of the porous body in accordance with the technique described in "6. Sessile Drop Method" of JIS R3257. Note that, the water used as the measurement liquid is distilled water.

In addition, the material of the water repellent porous body is not particularly limited as long as the contact angle of water is equal to or larger than 90°, and is preferably made of a water repellent resin. Further, it is preferable that the water repellent resin is a fluororesin. Specific examples of the fluororesin include polytetrafluoroethylene (hereinafter, referred to as PTFE), polychlorotrifluoroethylene (PCTFE), polyvinylidene fluoride (PVDF), polyvinyl fluoride (PVF), a perfluoroalkoxy fluororesin (PFA), a tetrafluoroethylene-propylenehexafluoride copolymer (FEP), an ethylene-tetrafluoroethylene copolymer (ETFE), and an ethylene chlorotrifluoroethylene copolymer (ECTFE). One kind or two or more kinds of these resins can be used if necessary, and a configuration in which a plurality of films are laminated may be used. Among them, polytetrafluoroethylene is preferable.

In a case where the single layer porous body described above is used as the liquid absorbing member, the surface layer having the average pore diameter S can be formed from the single layer porous body having the average pore diameter S.

<Multilayer Configuration>

Next, an embodiment in the case where the porous body has a multilayer configuration will be described. Here, a layer constituting the first surface in contact with the first image is referred to as the first layer, and a layer laminated on the surface opposite to the contact surface with the first image of the first layer is referred to as the second layer. Further, the configuration of the multilayers is sequentially expressed in the order of lamination from the first layer. In this specification, the first layer may be referred to as "absorbing layer" and the second layer and subsequent layers may be referred to as "support layer". In the present invention, the porous body may be a material having a large number of pores, for example, a material having many pores formed by the intersection of the fibers is also included in the porous body of the present invention.

[First Layer]

The first layer can be formed from the porous body described above in the section "(Porous body)".

In order to suppress the adhesion of the coloring material and to improve the cleaning property, it is preferable to use the above-described porous body having the water repellency in the first layer. Note that, the porous body having the water repellency means the porous body having the contact angle of water is equal to or larger than 90°. One kind or two or more kinds of these resins can be used if necessary, and a configuration in which a plurality of films are laminated in the first layer may be adopted.

In the case where the first layer is constituted by the porous body formed of a water repellent material, a pretreatment described later is preferably performed.

In the present invention, the film thickness of the first layer is preferably equal to or smaller than 50 μm, is more preferably equal to or smaller than 30 μm, and still more preferably 1 μm to 30 μm. In the examples of the present invention, the film thickness of each layer of the porous body was obtained by measuring the film thickness of any of ten points with a straight type micrometer OMV-25 (product name, manufactured by Mitutoyo Corporation), and then calculating the average value.

The first layer can be produced by a known method for producing a thin film porous membrane. For example, it can be obtained by molding a resin material into a sheet shape by a method such as extrusion molding, and stretching it to a predetermined thickness. Further, a plasticizer such as paraffin is added to a material at the time of extrusion molding, and the plasticizer is removed by heating or the like at the time of stretching so as to obtain a porous membrane. The pore diameter can be adjusted by appropriately adjusting the amount of the plasticizer to be added, a draw ratio, and the like.

[Second Layer]

In the present invention, the second layer is preferably a layer having air permeability. Such a layer may be a nonwoven fabric of a resin fiber or a woven fabric. The material of the second layer is not particularly limited, and is preferably a material in which the contact angle with the aqueous liquid component absorbed from the image with respect to the first layer is the same as or lower than that of the liquid absorbed to the first layer side so that the liquid absorbed to the first layer side does not flow backward. Specifically, the material of the second layer is preferably selected from a single material such as polyolefin (such as polyethylene (PE), polypropylene (PP)), polyurethane, nylon, polyamide, polyester (polyethylene terephthalate (PET), and the like), and polysulfone (PSF), or composites thereof. In addition, the second layer is preferably a layer having a pore diameter larger than that of the first layer.

[Third Layer]

In the present invention, the porous body of the porous structure may have a configuration having three or more layers. A nonwoven fabric is preferable as a layer after a third layer (also, referred to as a third layer) in view point of rigidity. The material which is the same as the second layer can be used.

In a case of using the porous body having a multilayer structure, the surface layer forming the first surface which comes into contact with the first image can be formed from the above-described first layer.

[Other Materials]

The liquid absorbing member may have a reinforcing member for reinforcing the side surface of the liquid absorbing member in addition to the porous body having the laminated structure. Further, the liquid absorbing member may have a joining member for joining longitudinal end portions of a long sheet-shaped porous body to form a belt-like member. As such a material, a non-porous tape material or the like can be used, and may be disposed at a position or a period where the material is not in contact with the image.

Method of Producing Porous Body

The method of forming the porous body by laminating the first layer and the second layer is not particularly limited. The porous body may be formed by only overlapping or adhering the first layer and the second layer to each other by using a method such as lamination by adhesive agent or lamination by heating. From the viewpoint of the air permeability, the lamination by heating is preferable in the present invention. Further, for example, by heating, a portion of the first layer or the second layer may be melted and laminated by adhesion. Alternatively, a fusing material such as a hot melt powder may be interposed between the first layer and the second layer such that the first layer and the second layer are adhered to each other by heating and thus are laminated. In the case of laminating the third layer or more, they may be laminated at once or may be laminated in order, and the order of laminating is appropriately selected.

In the heating step, a lamination method of heating the porous body by sandwiching the porous body with the heated roller in a pressurized state is preferable.

Specific embodiments of an ink jet recording apparatus to which the ink jet recording method of the present invention can be applied will be described.

As the ink jet recording apparatus of the present invention, apparatuses of the following types can be exemplified.

(A) An ink jet recording apparatus for forming a first image on a transfer body as an ink receiving medium and transferring an image (a second image) after the aqueous liquid component has been absorbed by a liquid absorbing member onto the ink recording medium.

(B) An ink jet recording apparatus for forming a first image on a recording medium as an ink receiving medium.

In the present invention, the former ink jet recording apparatus will hereinafter be referred to as a transfer type ink jet recording apparatus for the sake of convenience, and the latter ink jet recording apparatus is hereinafter referred to as a direct drawing type ink jet recording apparatus for the sake of convenience.

Each ink jet recording apparatus will be described below.

(Transfer Type Ink Jet Recording Apparatus)

FIG. 1 is a schematic diagram illustrating one example of a schematic configuration of a transfer type ink jet recording apparatus 100 of the present embodiment. The transfer type ink jet recording apparatus 100 includes a transfer body 101 for temporarily holding a first image and a second image obtained by absorbing at least a portion of an aqueous liquid component from the first image. The transfer type ink jet recording apparatus 100 also includes a transfer unit including a pressing member 106 for transferring the second image onto a recording medium 108 on which an image is to be formed. The transfer type ink jet recording apparatus 100 illustrated in FIG. 1 includes the transfer body 101 supported by a support member 102, a reaction liquid applying device 103 for applying a reaction liquid onto the transfer body 101, an ink applying device 104 for applying ink onto the transfer body 101 on which the reaction liquid is applied so as to form an ink image (the first image) on the transfer body, a liquid absorbing device 105 for absorbing a liquid component from the first image on the transfer body, and the pressing member 106 for transferring the second image on the transfer body from which the liquid component has been removed by pressing the recording medium onto the recording medium 108 such as paper. The first image on the transfer body becomes the second image by absorbing the liquid component by the liquid absorbing device 105 from the first image.

In addition, the transfer type ink jet recording apparatus 100 may include a cleaning member for transfer body 109 for cleaning the surface of the transfer body 101 after the second image is transferred onto the recording medium 108.

The support member 102 rotates about a rotation axis 102*a* in the direction of an arrow in FIG. 1. With the rotation of the support member 102, the transfer body 101 is rotationally moved. The application of the reaction liquid by the reaction liquid applying device 103 and the application of the ink by the ink applying device 104 are sequentially performed on the transfer body 101 to be moved, and thereby the first image is formed on the transfer body 101. The first image formed on the transfer body 101 is moved to a position where the first image comes into contact with the liquid absorbing member 105*a* of the liquid absorbing device 105 by the rotational movement of the transfer body 101.

The liquid absorbing member 105*a* of the liquid absorbing device 105 moves in synchronization with the rotation of the transfer body 101. The first image formed on the transfer body 101 passes through a state of being in contact with the moving liquid absorbing member 105*a*. During this time, the liquid absorbing member 105*a* removes the liquid component at least containing the aqueous liquid component from the first image.

Note that, the liquid component contained in the first image is removed by passing through the state of being in contact with the liquid absorbing member 105*a*. In this contact state, it is preferable that the liquid absorbing member 105*a* is pressed against the first image with a predetermined pressing force in order to effectively function the liquid absorbing member 105*a*.

The removal of the liquid component can be expressed from a different point of view as concentrating the ink constituting the image formed on the transfer body. Concentrating the ink means that the proportion of the solid content contained in the ink, such as coloring material and resin, with respect to the liquid component contained in the ink increases owing to reduction in the liquid component.

Then, the second image after the liquid component has been removed is moved to a transfer unit which is in contact with the recording medium 108 conveyed by a conveyance device 107 for the recording medium by the movement of the transfer body 101. The second image after the liquid component has been removed is transferred as an ink image onto the recording medium 108. The post-transfer ink image transferred onto the recording medium 108 is a reverse image of the second image. In the following description, the post-transfer ink image may be referred to as a third image separately from the first image (the ink image before liquid removal) and the second image (the ink image after liquid removal).

Note that, since the image is formed by applying ink after the reaction liquid is applied onto the transfer body, the reaction liquid remains in a non-image region (a non-ink image forming region) without reacting with the ink. In this apparatus, the liquid absorbing member 105*a* comes into contact (press contact) with not only the image but also the unreacted reaction liquid, and the liquid component of the reaction liquid is also removed from the surface of the transfer body 101.

Therefore, in the above description, it is expressed and described that the liquid component is removed from the image, but this is not limited to the meaning that the liquid component is removed from only the image, but means that a liquid component is removed from at least the image on the transfer body. For example, it is possible to remove the liquid component in the reaction liquid applied to the outer region of the first image together with the first image.

Note that, the liquid component is not particularly limited as long as it does not have a certain shape, has fluidity, and has a substantially constant volume. For example, water, an organic solvent, or the like contained in the ink and the reaction liquid are exemplified as a liquid component.

Also, even in a case where the clear ink is contained in the first image, it is possible to concentrate the ink by the liquid absorption treatment. For example, in a case where the clear ink is applied onto the color ink containing the coloring material applied onto the transfer body 101, the clear ink is present on the entire surface of the first image, or the clear ink is partially present at one or more places on the surface of the first image, and the color ink is present in other places. In the first image, in the places where the clear ink is present on the color ink, the porous body absorbs the liquid component of the clear ink on the surface of the first image and the liquid component of the clear ink moves. Accordingly, the liquid component in the color ink moves to the porous body side, and thereby the aqueous liquid component in the color ink is absorbed.

On the other hand, in the places where the clear ink and the color ink are present on the surface of the first image, the respective liquid components of the color ink and the clear ink move to the porous body side, and thereby the aqueous liquid component is absorbed. Note that, the clear ink may contain a large amount of components for improving transferability of the image from the transfer body 101 to the recording medium. For example, the content of the component that increases the adhesiveness to the recording medium by heating may be higher than that of the color ink.

Each configuration of the transfer type ink jet recording apparatus of the present embodiment will be described below.

<Transfer Body>

A transfer body 101 includes a surface layer including an image forming surface. As a member of the surface layer, various materials such as a resin and ceramics can be appropriately used, but from the viewpoint of durability and the like, a material having high compressive elastic modulus is preferable. Specifically, examples thereof include a condensate obtained by condensing an acrylic resin, an acrylic silicone resin, a fluorine-containing resin, and a hydrolyzable organosilicon compound. In order to improve the wettability and the transferability of the reaction liquid, the surface treatment may be performed before use. Examples of the surface treatment include a frame treatment, a corona treatment, a plasma treatment, a polishing treatment, a roughening treatment, an active energy ray irradiation treatment, an ozone treatment, a surfactant treatment, and a silane coupling treatment. These may be combined in plural. An optional surface shape can also be provided on the surface layer.

Further, it is preferable that the transfer body includes a compressible layer having a function of absorbing pressure fluctuation. When the compressible layer is provided, the compressible layer absorbs the deformation, disperses the variation against local pressure fluctuation, and maintains excellent transferability even during high-speed printing. Examples of members of the compressible layer include acrylonitrile-butadiene rubber, acrylic rubber, chloroprene rubber, urethane rubber, and silicone rubber. It is preferable that, at the time of molding the rubber material, a predetermined amount of a vulcanizing agent, a vulcanization accelerator and the like are blended, and a filler such as a foaming agent, a hollow fine particle or salt is further blended as necessary, to make the rubber material porous. As a result, a bubble portion is compressed with volume change for various pressure fluctuations, so that deformation in a direction other than the compression direction is small and a more stable transferability and the durability can be obtained. As the porous rubber material, there are one having continuous pore structure in which the pores are continuous to each other and one having independent pore structure in which the pores are independently separated from each other. In the present invention, any structure may be used, and these structures may be used in combination.

Further, the transfer body preferably includes an elastic layer between the surface layer and the compressible layer. As a material of the elastic layer, various materials such as resin, ceramics and the like can be appropriately used. Various elastomer materials and rubber materials are preferably used from the viewpoint of processing characteristics and the like. Specific examples thereof include fluorosilicone rubber, phenyl silicone rubber, fluororubber, chloroprene rubber, urethane rubber, nitrile rubber, ethylene propylene rubber, natural rubber, styrene rubber, isoprene rubber, butadiene rubber, a copolymer of ethylene/propylene/butadiene, and nitrile butadiene rubber. In particular, silicone rubber, fluorosilicone rubber, and phenyl silicone rubber are preferable in terms of dimensional stability and the durability because of small compression set. In addition, the change in the elastic modulus due to temperature is small, which is also preferable from the viewpoint of transferability.

Various adhesives or double-sided tapes may be used between the layers constituting the transfer body (the surface layer, the elastic layer, and the compressible layer) in order to fix and hold the layers. A reinforcing layer having a high compressive elastic modulus may be provided for suppressing lateral elongation when being mounted on the device and for maintaining elasticity. Further, the woven fabric may be used as a reinforcing layer. The transfer body can be produced by optionally combining each layer by the above-described material.

The size of the transfer body can be freely selected according to the size of the target print image. The shape of the transfer body is not particularly limited, and specifically, examples thereof include a sheet shape, a roller shape, a belt shape, and an endless web shape.

<Support Member>

The transfer body 101 is supported on the support member 102. As a method of supporting the transfer body, various adhesives or double-sided tapes may be used. Alternatively, by attaching a mounting member made of a material such as metal, ceramic, and a resin to the transfer body, the transfer body may be supported on the support member 102 using the mounting member.

The support member 102 is required to have a certain degree of structural strength from the viewpoint of conveying accuracy and durability. For the material of the support member, metal, ceramic, resin, or the like is preferably used. Among them, in particular, in order to improve responsiveness of control by reducing inertia during operation in addition to rigidity and dimensional accuracy that can withstand pressurization at the time of transfer, aluminum, iron, stainless steel, acetal resin, epoxy resin, polyimide, polyethylene, polyethylene terephthalate, nylon, polyurethane, silica ceramics, alumina ceramics are preferably used. Further, these are preferably used in combination.

The ink jet recording apparatus of the present embodiment includes the reaction liquid applying device 103 for applying the reaction liquid to the transfer body 101. The reaction liquid applying device 103 illustrated in FIG. 1 indicates a gravure offset roller which is provided with a reaction liquid storing unit 103*a* for storing the reaction liquid and a reaction liquid applying members 103*b* and 103*c* for applying the reaction liquid in the reaction liquid storing unit 103*a* onto the transfer body 101.

<Ink Applying Device>

The ink jet recording apparatus of the present embodiment includes an ink applying device 104 that applies ink to the transfer body 101 to which the reaction liquid is applied. The first image is formed by mixing the reaction liquid and the ink, and in the subsequent liquid absorbing device 105, the liquid component is absorbed from the first image.

<Liquid Absorbing Device>

In the present embodiment, the liquid absorbing device 105 includes the liquid absorbing member 105*a*, and a pressing member 105*b* for liquid absorption which presses the liquid absorbing member 105*a* against the first image on the transfer body 101.

As illustrated in FIG. 1, the pressing member 105*b* operates to press the second surface, which is the back surface of the first surface of the liquid absorbing member 105*a*, so that the first surface is brought into contact with the outer peripheral surface of the transfer body 101. By allowing the first image to pass through a nip portion formed by this contact, the liquid absorption treatment from the first image can be performed. The liquid absorbing member 105*a* is pressed to use the region where the liquid absorbing member 105*a* is brought into contact with the outer peripheral surface of the transfer body 101 as the liquid absorption treatment region.

The position of the pressing member 105*b* with respect to the transfer body 101 and the pressurizing of the pressing member 105*b* against the transfer body 101 can be adjusted by position control and a pressurizing mechanism (not shown). For example, it is possible to make the pressing member 105*b* reciprocatable in the direction of double arrow A indicated in the drawing, and the liquid absorbing member 105*a* can be brought into contact with the outer peripheral surface of the transfer body 101 at the timing when the liquid absorption treatment is required and can be separated from this outer peripheral surface.

Note that, the shape of the liquid absorbing member 105*a* and the pressing member 105*b* is not particularly limited. For example, as illustrated in FIG. 1, a configuration in which the pressing member 105*b* has a columnar shape, the liquid absorbing member 105*a* has a belt shape, and the liquid absorbing member 105*a* having the belt shape is pressed against the transfer body 101 by the pressing member 105*b* having the columnar shape may be employed. In addition, a configuration in which the pressing member 105*b* has a columnar shape, the liquid absorbing member 105*a* has a cylindrical shape formed on the peripheral surface of the pressing member 105*b* having the columnar shape, and the liquid absorbing member 105*a* having the cylindrical shape is pressed against the transfer body by the pressing member 105*b* having the columnar shape may be employed.

In the present invention, it is preferable that the liquid absorbing member 105*a* has the belt shape in consideration of the space and the like in the ink jet recording apparatus.

In addition, the liquid absorbing device 105 which includes the liquid absorbing member 105*a* having such a belt shape may include an extending member for extending the liquid absorbing member 105*a*. In FIG. 1, reference numerals 105*c*, 105*d*, and 105*e* represent an extending roller as the extending member. These rollers and the belt-shaped liquid absorbing member 105*a* stretched around these rollers constitute a conveyance unit that conveys the liquid absorbing member for performing the liquid absorption treatment from the first image. With this conveyance unit, it is possible to carry in, carry out and retransmit the liquid absorbing member to a liquid absorption treatment region.

In FIG. 1, the pressing member 105*b* is also a roller member that rotates similarly to the extending roller, but the present invention is not limited thereto.

In the liquid absorbing device 105, when the liquid absorbing member 105*a* including the porous body is pressed to the first image by the pressing member 105*b*, the liquid component contained in the first image is absorbed to the liquid absorbing member 105*a*, and thereby the liquid component is removed from the first image. As a method of removing the liquid component from the first image, in addition to the present method of pressing the liquid absorbing member, other various conventionally used methods, for example, a method of heating, a method of blowing low humidity air, and a method of reducing pressure may be used in combination.

Hereinafter, various conditions and configurations in the liquid absorbing device 105 will be described in detail.

(Pretreatment)

A pretreatment is preferably performed by pretreatment means (not shown in FIGS. 1 and 2) for applying a wetting liquid to the liquid absorbing member before bringing the liquid absorbing member having the porous body into contact with the image. The wetting liquid preferably contains water and a water-soluble organic solvent. Water is preferably deionized water by ion exchange or the like. Further, the kinds of the water-soluble organic solvents to be used are not particularly limited, and any of known organic solvents such as ethanol and isopropyl alcohol can be used. In the pretreatment of the liquid absorbing member used in the present invention, the method of applying the wetting liquid to the porous body is not particularly limited, and immersion and liquid droplet dripping are preferable.

(Pressurizing Condition)

When the pressure (contact pressure P) of the liquid absorbing member pressing against the first image on the transfer body is equal to or greater than 0.3 kgf/cm$^2$, the liquid component in the first image can be solid-liquid separated in a shorter time period, and the liquid component can be removed from the first image, which is preferable. In the present invention, the pressure of the liquid absorbing member indicates a nip pressure between the transfer body 101 and the liquid absorbing member 105*a*, and the value of the pressure is calculated by performing surface pressure measurement by using a surface pressure distribution measuring device (I-SCAN (product name), manufactured by NITTA Corporation), and dividing the load in the pressurized region by the area.

It is preferable that the application time of bringing the liquid absorbing member 105*a* into contact with the image is within 50 ms (milliseconds) in order to further suppress the adhesion of the coloring material in the image to the liquid absorbing member. In addition, when the application time is equal to or longer than 3 ms, the liquid absorbing member 105*a* can be brought into stable contact with the first image, which is preferable. Incidentally, the application time in the present invention is calculated by dividing a pressure sensing width in the moving direction of the transfer body 101 in the above-described surface pressure measurement by the moving speed of the transfer body 101. Hereinafter, this application time is referred to as a liquid absorbing nip time.

(Porous Body)

As the liquid absorbing member, the porous body having an average pore diameter S of the surface layer described above can be exemplified.

(Method of Removing Liquid from Liquid Absorbing Member)

The liquid component absorbed by the liquid absorbing member from the image can be removed from the liquid absorbing member 105*a* by known means. Examples thereof include a method of heating, a method of blowing low humidity air, a method of reducing pressure, and a method of squeezing the porous body.

In this way, on the transfer body 101, the liquid component is absorbed from the first image and a second image with reduced liquid content is formed. The second image is then transferred onto the recording medium 108 at the transfer unit. A device configuration and conditions at the time of transfer will be described.

<Pressing Member for Transferring>

In the present embodiment, while the second image and the recording medium 108 conveyed by the conveyance device 107 for the recording medium are in contact with each other, the pressing member 106 for transferring presses the recording medium 108, and thereby an ink image is transferred onto the recording medium 108. When removing the liquid component contained in the first image on the transfer body 101, and then transferring it onto the recording medium 108, it is possible to obtain a recorded image in which curling, cockling, and the like are suppressed. As a pressing member for transferring, a transfer roller can be preferably used.

The pressing member 106 is required to have a certain degree of structural strength from the viewpoint of conveying accuracy and durability of the recording medium 108. For the material of the pressing member 106, metal, ceramic, resin, or the like is preferably used. Among them, in particular, in order to improve responsiveness of control by reducing inertia during operation in addition to rigidity and dimensional accuracy that can withstand pressurization at the time of transfer, aluminum, iron, stainless steel, acetal resin, epoxy resin, polyimide, polyethylene, polyethylene terephthalate, nylon, polyurethane, silica ceramics, and alumina ceramics are preferably used. Further, these may be used in combination.

The pressing time of the pressing member 106 for transferring the second image on the transfer body 101 onto the recording medium 108 is not particularly limited, and in order not to impair the transferability and the durability of the transfer body, it is preferably 5 ms to 100 ms. In the present embodiment, the pressurizing time indicates the time during which the recording medium 108 and the transfer body 101 are in contact with each other, and the value of the time is calculated by performing the surface pressure measurement by using the surface pressure distribution measuring device (I-SCAN (product name), manufactured by NITTA Corporation), and dividing the length in the conveying direction of the pressure region by the conveying speed.

In addition, the pressure pressed by the pressing member 106 for transferring the second image on the transfer body 101 onto the recording medium 108 is not particularly limited as long as the transfer is performed well and the durability of the transfer body is not impaired. Therefore, it is preferable that the pressure is 9.8 N/cm$^2$ (1 kg/cm$^2$) to 294.2 N/cm$^2$ (30 kg/cm$^2$). Incidentally, the pressure in the present embodiment indicates the nip pressure between the recording medium 108 and the transfer body 101, and the value of the pressure is calculated by performing the surface pressure measurement by the surface pressure distribution measuring device, and dividing the load in the pressure region by the area.

The temperature at which the pressing member 106 presses for transferring the second image on the transfer body 101 onto the recording medium 108 is also not particularly limited, and it is preferably equal to or higher than a glass transition point or equal to or higher than a softening point of a resin component contained in the ink. For heating, it is preferable to provide a heating device for heating the second image on the transfer body 101, the transfer body 101, and the recording medium 108.

The shape of the transfer member 106 is not particularly limited, but for example, a roller shape can be mentioned.

<Recording Medium and Conveyance Device for Recording Medium>

In the present embodiment, the recording medium 108 is not particularly limited, and any of known recording media can be used. As the recording medium, a long object wound in a roll shape or a sheet material cut into a predetermined size can be exemplified. Examples of the materials include paper, a plastic film, a wood board, a cardboard, and a metal film.

In FIG. 1, the conveyance device 107 for recording medium for conveying the recording medium 108 is constituted by a feeding roller 107*a* for recording medium and a winding roller 107*b* for recording medium, but it is not particularly limited thereto as long as the recording medium can be conveyed.

<Control System>

Figure 3:
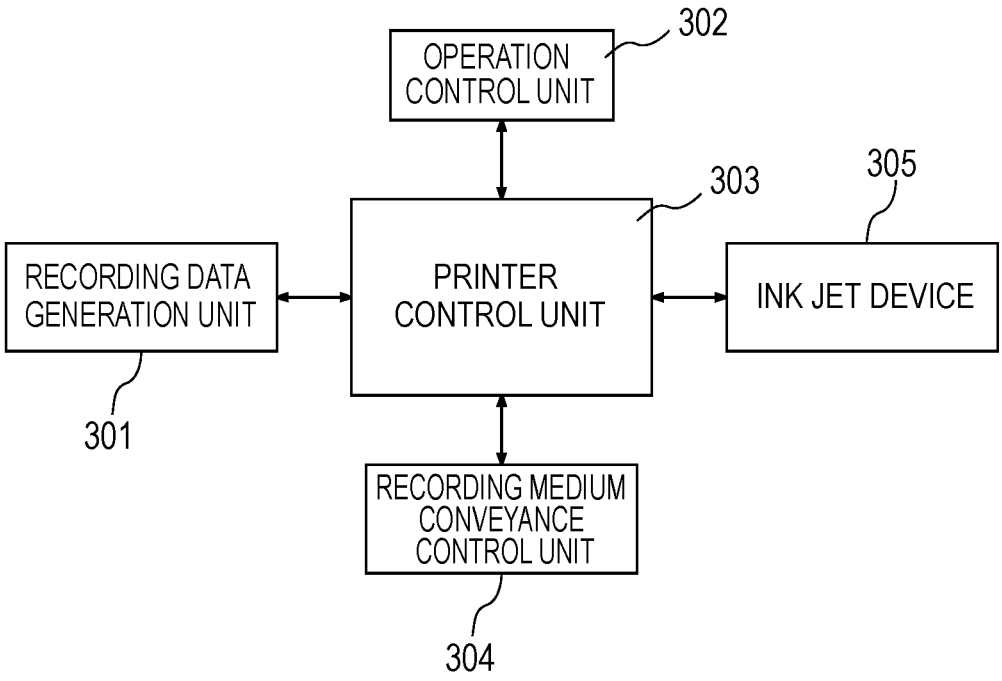
FIG. 3 is a block diagram illustrating a control system of the entire apparatus in the transfer type ink jet recording apparatus illustrated in FIG. 1.

The transfer type ink jet recording apparatus in the present embodiment includes a control system for controlling each devices. FIG. 3 is a block diagram illustrating a control system of the entire apparatus in the transfer type ink jet recording apparatus illustrated in FIG. 1.

In FIG. 3, a reference numeral 301 represents a recording data generation unit such as an external print server, a reference numeral 302 represents an operation control unit such as an operation panel, a reference numeral 303 represents a printer control unit for executing a recording process, a reference numeral 304 represents a recording medium conveyance control unit for conveying the recording medium, and a reference numeral 305 represents an ink jet device for printing.

Figure 4:
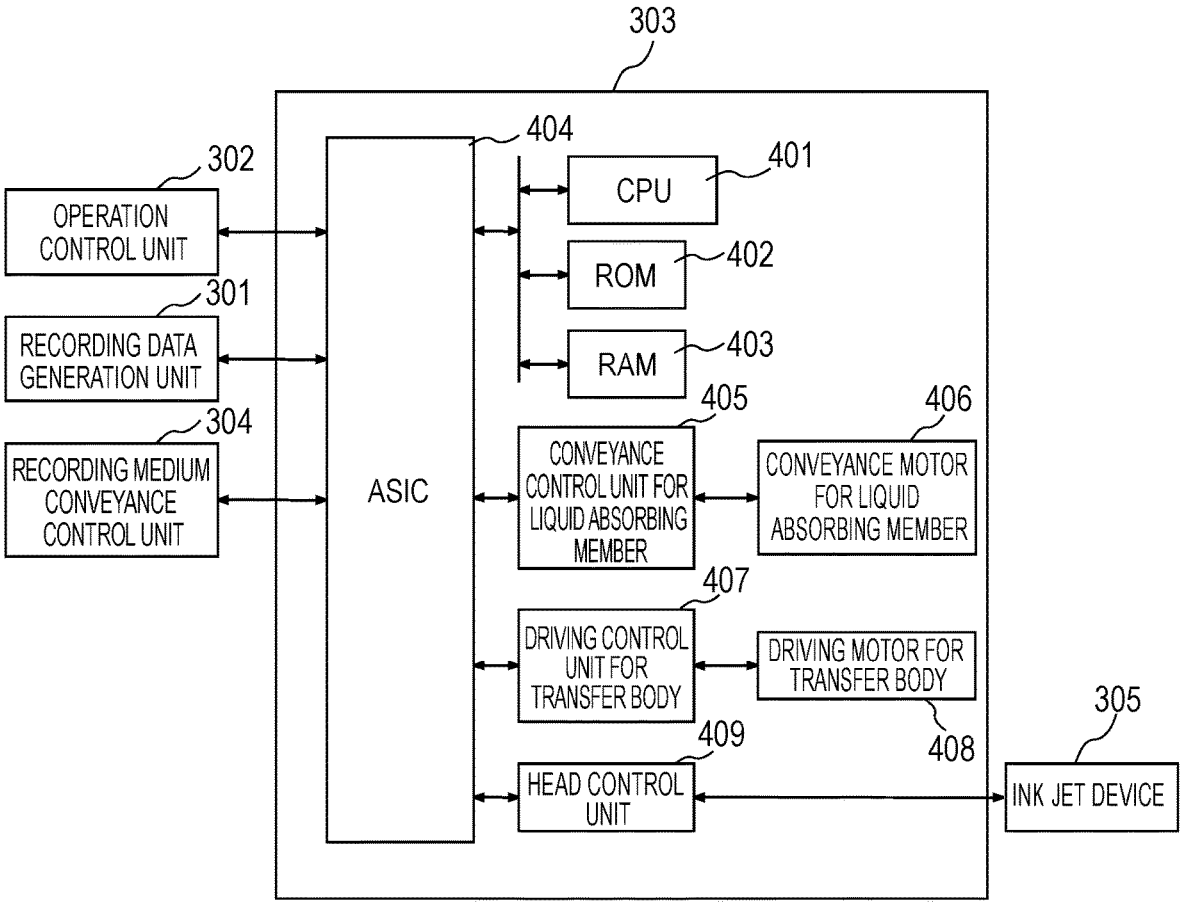
FIG. 4 is a block diagram of a printer control unit in the transfer type ink jet recording apparatus illustrated in FIG. 1.

FIG. 4 is a block diagram of a printer control unit in the transfer type ink jet recording apparatus illustrated in FIG. 1.

A reference numeral 401 represents a CPU for controlling the entire printer, a reference numeral 402 represents a ROM for storing a control program of the CPU, and a reference numeral 403 represents a RAM for executing the program. A reference numeral 404 represents an application specific integrated circuit (ASIC) including a network controller, a serial IF controller, a controller for generating head data, a motor controller, and the like. A reference numeral 405 represents a conveyance control unit for liquid absorbing member that drives a conveyance motor 406 for liquid absorbing member, and the conveyance control unit 405 for liquid absorbing member is controlled by a command from the ASIC 404 via the serial IF. A reference numeral 407 represents a driving control unit for transfer body that drives a driving motor 408 for transfer body, and similarly, the driving control unit 407 for transfer body is controlled by a command from the ASIC 404 via the serial IF. A reference numeral 409 represents a head control unit that performs final ejection data generation, drive voltage generation, and the like of the ink jet device 305.

(Direct Drawing Type Ink Jet Recording Apparatus)

As another embodiment of the present invention, a direct drawing type ink jet recording apparatus can be mentioned. In the direct drawing type ink jet recording apparatus, the ink receiving medium is a recording medium on which an image is to be formed.

Figure 2:
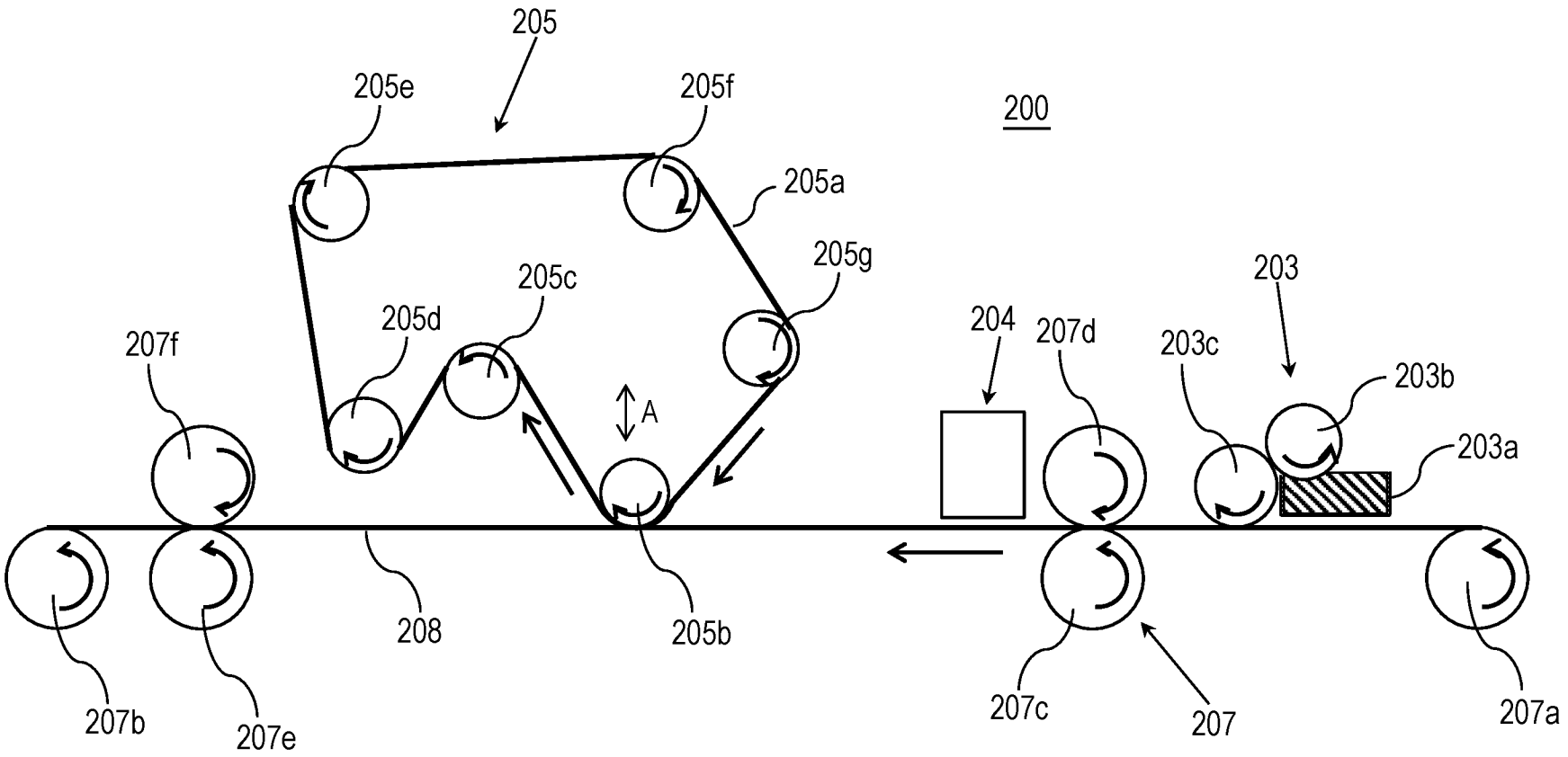
FIG. 2 is a schematic diagram illustrating one example of a configuration of a direct drawing type ink jet recording apparatus according to the present invention.

FIG. 2 is a schematic diagram illustrating one example of a schematic configuration of a direct drawing type ink jet recording apparatus 200 of the present embodiment. Compared to the transfer type ink jet recording apparatus described above, the direct drawing type ink jet recording apparatus has units similar to those of the transfer type ink jet recording apparatus with the exception that it does not have the transfer body 101, the support member 102, and the cleaning member 109 for transfer body, and forms an image on a recording medium 208.

Therefore, by means of a reaction liquid applying device 203 for applying the reaction liquid to the recording medium 208, an ink applying device 204 for applying ink to the recording medium 208, and a liquid absorbing member 205*a* coming into contact with a first image on the recording medium 208, a liquid absorbing device 205 that absorbs the liquid component contained in the first image has the same configuration as that of the transfer type ink jet recording apparatus, and thus explanation thereof will not be described.

Note that, in the direct drawing type ink jet recording apparatus of the present embodiment, the liquid absorbing device 205 includes the liquid absorbing member 205*a*, and a pressing member 205*b* for liquid absorption which presses the liquid absorbing member 205*a* against the first image on the recording medium 208. The shapes of the liquid absorbing member 205*a* and the pressing member 205*b* are not particularly limited, and it is possible to use the same shapes as the liquid absorbing member and the pressing member that can be used in the transfer type ink jet recording apparatus.

In addition, the liquid absorbing device 205 may include an extending member for extending the liquid absorbing member. In FIG. 2, reference numerals 205*c*, 205*d*, 205*e*, 205*f*, and 205*g* represent an extending roller as the extending member. The number of the extending rollers is not limited to five as illustrated in FIG. 2, and a necessary number of the extending rollers may be arranged according to the apparatus design. A recording medium support member (not shown) for supporting the recording medium from below may be provided at a position facing an ink applying unit for applying ink to the recording medium 208 by the ink applying device 204 and a liquid component removing unit for pressing the liquid absorbing member 205*a* against the first image on the recording medium to remove the liquid component.

<Conveyance Device for Recording Medium>

In the direct drawing type ink jet recording apparatus of the present embodiment, a conveyance device for recording medium 207 is not particularly limited, and a conveyance device in a known direct drawing type ink jet recording apparatus can be used. Examples thereof include, as illustrated in FIG. 2, a conveyance device for recording medium including a feeding roller 207*a* for recording medium, a winding roller 207*b* for recording medium, and conveyance rollers 207*c*, 207*d*, 207*e*, and 207*f* for recording medium.

<Control System>

The direct drawing type ink jet recording apparatus in the present embodiment has a control system for controlling each devices. The block diagram illustrating a control system of the entire apparatus in the direct drawing type ink jet recording apparatus illustrated in FIG. 2 is as illustrated in FIG. 5 similar to the transfer type ink jet recording apparatus illustrated in FIG. 1.

Figure 5:
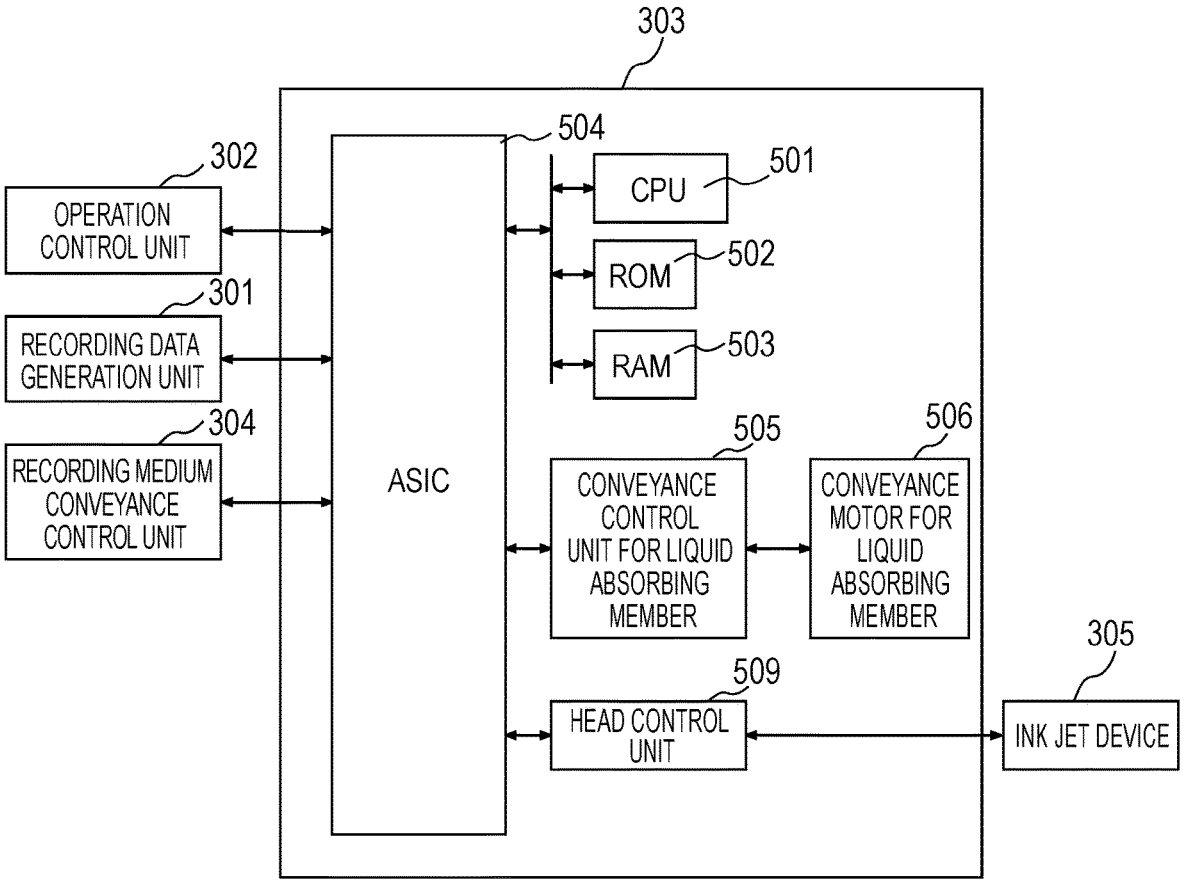
FIG. 5 is a block diagram of a printer control unit in the direct drawing type ink jet recording apparatus illustrated in FIG. 2.

FIG. 5 is a block diagram of a printer control unit in the direct drawing type ink jet recording apparatus illustrated in FIG. 2. Except for not including the driving control unit 407 for transfer body and the driving motor 408 for transfer body, FIG. 5 is the same block diagram as the block diagram of the printer control unit in the transfer type ink jet recording apparatus in FIG. 3.

In other words, reference numeral 501 represents a CPU for controlling the entire printer, a reference numeral 502 represents a ROM for storing a control program of the CPU, and a reference numeral 503 represents a RAM for executing the program. A reference numeral 504 represents an ASIC including a network controller, a serial IF controller, a controller for generating head data, a motor controller, and the like. A reference numeral 505 represents a conveyance control unit for liquid absorbing member for driving a conveyance motor for liquid absorbing member 506, and the conveyance control unit for liquid absorbing member 505 is controlled by a command from the ASIC 504 via the serial IF. A reference numeral 509 represents a head control unit which performs final ejection data generation, drive voltage generation, and the like of the ink jet device 305.

EXAMPLES

Hereinafter, the present invention will be more specifically described with reference to examples and comparative examples. The present invention is not limited by the following examples without departing from the gist thereof. In the description of the following examples, "part" is on a mass basis unless otherwise specified. In the present example, the transfer type ink jet recording apparatus shown in FIG. 1 was used.

The transfer body 101 in the present embodiment is fixed to the surface of the support member 102 with an adhesive. In the present embodiment, a coated sheet obtained by coating a PET sheet having a thickness of 0.5 mm with silicone rubber (KE12 (product name), manufactured by Shin-Etsu Chemical Co., Ltd.) by a thickness of 0.3 mm was used as an elastic layer of the transfer body 101. Further, a mixture of a condensation product obtained by mixing glycidoxypropyl triethoxy silane and methyl triethoxy silane at a molar ratio of 1:1, and heating it under reflux, and a photo cationic polymerization initiator (SP 150 (product name), manufactured by ADEKA) was produced. An atmospheric pressure plasma treatment was performed on the elastic layer surface so that the contact angle of water on the surface of the elastic layer is equal to or smaller than 10 degrees, the mixture was applied onto the elastic layer, and the mixture was formed into a film by UV irradiation (high pressure mercury lamp, integrated exposure amount 5,000 mJ/cm$^2$) and thermal curing (150° C. for two hours) so as to form a transfer body 101 in which a surface layer having a thickness of 0.5 μm was formed on the elastic body.

In this configuration, although illustration is omitted for simplicity of explanation, a double-sided tape was used between the transfer body 101 and the support member 102 so as to hold the transfer body 101.

Further, in the present configuration, the surface temperature of the transfer body 101 was set to be 60° C. by heating means (not shown).

As the ink applying means 104, an ink jet head of the type which ejects ink by an on-demand method using an electrothermal converter was used, and a solid image was formed on the transfer body. The ink applying amount at the time of forming the solid image was set at 20 g/m$^2$ at the maximum. The liquid absorbing member 105*a* is adjusted by conveyance rollers 105*c*, 105*d*, and 105*e* which extend and convey the liquid absorbing member such that the speed of the liquid absorbing member 105*a* becomes equal to the moving speed of the transfer body 101. Further, in order that a speed of the recording medium 108 becomes equal to the moving speed of the transfer body 101, the recording medium 108 is conveyed by the feeding roller 107*a* for recording medium and the winding roller 107*b* for recording medium. In this example, the conveyance speed was 0.4 m/s, and aurora coated paper (product name, manufactured by Nippon Paper Industries Co., Ltd., basis weight 104 g/m$^2$) was used as the recording medium 108.

[Preparation of Reaction Liquid]

As the reaction liquid applied by the reaction liquid applying device 103, a solution having the following composition was used. The applying amount of the reaction liquid by the reaction liquid applying device 103 was set to 0.6 g/m$^2$.

<Reaction Liquid 1>

Citric acid: 30.0 parts
Potassium hydroxide: 3.5 parts
Glycerin: 5.0 parts
Surfactant (product name: Megafac F444, manufactured by DIC Corporation): 3.0 parts
Ion exchanged water: remainder <Reaction Liquid 2>

Malic acid: 50.0 parts
Potassium hydroxide: 3 parts
Glycerin: 5.0 parts
Surfactant (product name: Megafac F444, manufactured by DIC Corporation): 3.0 parts
Ion exchanged water: remainder <Reaction liquid 3>

Calcium chloride aqueous solution (calcium chloride content is 20.0% by mass): 92.0 parts
Glycerin: 5.0 parts
Surfactant (product name: Megafac F444, manufactured by DIC Corporation): 3.0 parts

[Preparation of Ink]

The ink was prepared as follows.

<Preparation of Pigment Dispersion>

10 parts of carbon black (product name: Monarch 1100, manufactured by Cabot Corporation), 15 parts of aqueous resin solution (obtained by neutralizing a styrene-ethyl acrylate-acrylic acid copolymer and an aqueous solution having an acid value of 150, a weight average molecular weight (Mw) of 8,000, and a resin content of 20.0% by mass with an aqueous potassium hydroxide solution), and 75 parts of pure water were mixed, the mixture was charged into a batch type vertical sand mill (manufactured by AIMEX CO., Ltd.), the batch type vertical sand mill was filled with 200 parts of zirconia beads having a diameter of 0.3 mm, and a dispersion treatment was performed for five hours while cooling with water. The dispersion was centrifuged to remove coarse particles, and then a black pigment dispersion having a pigment content of 10.0% by mass was obtained.

<Preparation of Resin Fine Particle Dispersion 1>

18 parts of ethyl methacrylate, 3 parts of 2,2'-azobis-(2-methyl butyronitrile), and 2 parts of n-hexadecane were mixed and stirred for 0.5 hours. This mixture was added dropwise to 75 parts of an 8% aqueous solution of a styrene-butyl acrylate-acrylic acid copolymer (acid value: 130 mgKOH/g, weight average molecular weight (Mw): 7,000), and stirred for 0.4 hours. Next, ultrasonic waves were irradiated by an ultrasonic irradiator for three hours. Subsequently, a polymerization reaction was performed at 80° C. for four hours in a nitrogen atmosphere, and after cooling at room temperature, filtration was performed so as to prepare a resin fine particle dispersion 1 having a resin content of 25.0% by mass.

<Preparation of ink 1>

The resin fine particle dispersion 1 and the pigment dispersion obtained above were mixed with each of the following components. Note that, the remainder of the ion exchanged water is an amount such that the total of all components constituting the ink is 100.0% by mass.

Pigment dispersion (the content of the coloring material is 10.0% by mass): 40.0% by mass
Resin fine particle dispersion 1: 20.0% by mass
Glycerin: 7.0% by mass
Polyethylene glycol (number average molecular weight (Mn): 1,000): 3.0% by mass
Surfactant: acetylenol E100 (product name, manufactured by Kawaken Fine Chemicals Co., Ltd.): 0.5% by mass
Ion exchanged water: remainder After sufficiently stirring and dispersing the mixture, pressure filtration was performed with a microfilter (manufactured by FUJIFILM Corporation) having a pore diameter of 3.0 μm so as to prepare ink 1.

The particle diameter d50 (before) of the solid content contained in the ink 1 was 0.14 μm. The particle diameter of the ink 1 was measured using Nanotrac 150 (product name, manufactured by MicrotracBEL Corp.), by diluting to 1/200 with water, under conditions of a "transmission" mode, a particle refractive index of "1.80", the shape of "non-spherical", the density of "1.00", and the solvent refractive index of "1.33".

<Preparation of resin fine particle dispersion 2>

25 parts of ethyl methacrylate, 3 parts of 2,2'-azobis-(2-methyl butyronitrile), and 2 parts of n-hexadecane were mixed and stirred for 0.5 hours. This mixture was added dropwise to 73 parts of a 9% aqueous solution of a styrene-butyl acrylate-acrylic acid copolymer (acid value: 140 mgKOH/g, weight average molecular weight (Mw): 6,000), and stirred for 0.5 hours. Next, ultrasonic waves were irradiated by an ultrasonic irradiator for three hours. Subsequently, a polymerization reaction was performed at 80° C. for six hours in a nitrogen atmosphere, and after cooling at room temperature, filtration was performed so as to prepare a resin fine particle dispersion having a resin content of 25.0% by mass.

<Preparation of Ink 2>

The resin fine particle dispersion 2 and the pigment dispersion obtained above were mixed with each of the following components. Note that, the remainder of the ion exchanged water is an amount such that the total of all components constituting the ink is 100.0% by mass.

Pigment dispersion (the content of the coloring material is 10.0% by mass): 40.0% by mass
Resin fine particle dispersion 2: 20.0% by mass
Glycerin: 7.0% by mass
Polyethylene glycol (number average molecular weight (Mn): 1,000): 3.0% by mass
Surfactant: acetylenol E100 (product name, manufactured by Kawaken Fine Chemicals Co., Ltd.): 0.5% by mass
Ion exchanged water: remainder After sufficiently stirring and dispersing the mixture, pressure filtration was performed with a microfilter (manufactured by FUJIFILM Corporation) having a pore diameter of 3.0 μm so as to prepare ink 2.

The particle diameter d50 (before) of the solid content contained in the ink 2 was 0.23 The particle diameter of the ink 2 was measured by the same method as for the ink 1.

<Preparation of Resin Fine Particle Dispersion 3>

2 parts of n-hexadecane, 10 parts of hexadecyl methacrylate, 10 parts of propyl methacrylate, and 2 parts of 2,2'-azobis-(2-methyl butyronitrile) were mixed and stirred for 0.5 hours. This mixture was added dropwise to 76 parts of 5% NIKKOL BC 15 (product name, manufactured by Nikko Chemicals Co., Ltd.) aqueous solution and stirred for 0.5 hours. Next, ultrasonic waves were irradiated by an ultrasonic irradiator for three hours. Subsequently, a polymerization reaction was performed at 80° C. for four hours in a nitrogen atmosphere so as to prepare a resin fine particle dispersion 3 having a resin content of 25.0% by mass.

<Preparation of Ink 3>

The resin fine particle dispersion 3 and the pigment dispersion obtained above were mixed with each of the following components. Note that, the remainder of the ion exchanged water is an amount such that the total of all components constituting the ink is 100.0% by mass.

Pigment dispersion (the content of the coloring material is 10.0% by mass): 40.0% by mass
Resin fine particle dispersion 3: 20.0% by mass
Glycerin: 7.0% by mass
Polyethylene glycol (number average molecular weight (Mn): 1,000): 3.0% by mass
Surfactant: acetylenol E100 (product name, manufactured by Kawaken Fine Chemicals Co., Ltd.): 0.5% by mass
Ion exchanged water: remainder After sufficiently stirring and dispersing the mixture, pressure filtration was performed with a microfilter (manufactured by FUJIFILM Corporation) having a pore diameter of 3.0 μm so as to prepare ink 3.

The particle diameter d50 (before) of the solid content contained in the ink 3 was 0.11 μm. The particle diameter of the ink 3 was measured by the same method as for the ink 1. Note that, unlike inks 1 and 2, the ink 3 does not contain the resin fine particle that reacts with the reaction liquid.

<Preparation of Ink 4>

The pigment dispersion was mixed with the following components. Note that, the remainder of the ion exchanged water is an amount such that the total of all components constituting the ink is 100.0% by mass.

Pigment dispersion (the content of the coloring material is 10.0% by mass): 40.0% by mass
Glycerin: 7.0% by mass
Polyethylene glycol (number average molecular weight (Mn): 1,000): 3.0% by mass
Surfactant: acetylenol E100 (product name, manufactured by Kawaken Fine Chemicals Co., Ltd.): 0.5% by mass
Ion exchanged water: remainder After sufficiently stirring and dispersing the mixture, pressure filtration was performed with a microfilter (manufactured by FUJIFILM Corporation) having a pore diameter of 3.0 μm so as to prepare ink 4.

The particle diameter d50 (before) of the solid content contained in the ink 4 was 0.09 μm. The particle diameter of the ink 4 was measured by the same method as for the ink 1.

[Liquid Absorbing Member]

In the present example, before contacting with the first image, the liquid absorbing member 105*a* was immersed in a wetting liquid consisting of 95 parts of ethanol and 5 parts of water, permeated and then substituted with a liquid consisting of 100 parts of water. The liquid absorbing member 105*a* after the aforementioned treatment was used for liquid removal from the first image.

In addition, pressure is applied to the liquid absorbing member 105*b* so that the average pressure of the nip pressure between the transfer body 101 and the liquid absorbing member 105*a* becomes 2 kg/cm$^2$. Further, in liquid absorbing means, the pressing member 105*b* having a roller diameter of Φ200 mm was used.

As the first layer of the liquid absorbing member 105*a*, materials indicated in the following Table 1 and layers having an average pore diameter were prepared. Note that, the average pore diameter in the following Table 1 was measured by using POROMETER 3 Gz (product name, manufactured by Quantachrome Instruments). In addition, regarding the average pore diameter in Table 1, "2 μm" of a liquid absorbing member **105*a*-1 means "2.0 μm", "1 μm" of a liquid absorbing member 105*a*-2 means "1.0 μm", and "5 μm" of a liquid absorbing member 105*a*-6** means "5.0 μm".

The liquid absorbing members **105*a*-1, 105*a*-2, 105*a*-3, 105*a*-4, and 105*a*-6** were formed by compression molding of crystallized polypropylene emulsion polymerized particles and stretching at a temperature equal to or lower than the melting point so as to obtain a fibrillated porous body. The pore diameter was controlled by adjusting the stretching speed and temperature.

Likewise, the liquid absorbing member **104*a*-5** was formed by compression molding of highly-crystallized PTFE emulsion polymerized particles and stretching at a temperature equal to or lower than the melting point so as to obtain a fibrillated porous body.

A polyolefin nonwoven fabric HOP60 (product name, manufactured by HIROSE PAPER MFG CO., LTD.) was laminated so as to be used as the second layer.

TABLE 1

| | Material | Average pore diameter [μm] |
|---|---|---|
| Liquid absorbing member 105a-1 | Polypropylene | 2 |
| Liquid absorbing member 105a-2 | Polypropylene | 1 |
| Liquid absorbing member 105a-3 | Polypropylene | 0.4 |
| Liquid absorbing member 105a-4 | Polypropylene | 0.1 |
| Liquid absorbing member 105a-5 | Polytetrafluoroethylene | 0.4 |
| Liquid absorbing member 105a-6 | Polypropylene | 5 |

Examples 1 to 8 and Comparative Examples 1 to 4

The above-described reaction liquids 1, 2, and 3, inks 1, 2, 3, and 4, liquid absorbing members **105*a*-1, 105*a*-2, 105*a*-3, 105*a*-4, 105*a*-5, and 105*a*-6** were combined and were compared and examined as indicated in the following Table 2. An evaluation method will be described below.

Note that, the average particle diameter d 50 (after) of the solid content contained in the mixture of the reaction liquid and the ink in the following Table 2 was measured as follows. First, 0.6 g of each of the reaction liquid diluted to 1/10 with water was added to 20 g of ink, and the mixture was stirred for five minutes at 300 R.P.M using a stirrer. The obtained mixture of ink and reaction liquid was diluted to 1/200 with water and calculated from the volume average particle diameter measured with Nanotrac 150 (product name, manufactured by MicrotracBEL Corp.) in five minutes.

TABLE 2

| | Ink | Reaction liquid | Liquid absorbing member | Average particle diameter d50 (before) of solid content contained in ink [μm] | Average particle diameter d50 (after) of solid content contained in mixture of reaction liquid and ink [μm] |
|---|---|---|---|---|---|
| Example 1 | Ink 1 | Reaction liquid 1 | Liquid absorbing member 105a-1 | 0.14 | 2.8 |
| Example 2 | Ink 1 | Reaction liquid 1 | Liquid absorbing member 105a-2 | 0.14 | 2.8 |
| Example 3 | Ink 1 | Reaction liquid 1 | Liquid absorbing member 105a-3 | 0.14 | 2.8 |
| Example 4 | Ink 1 | Reaction liquid 1 | Liquid absorbing member 105a-4 | 0.14 | 2.8 |
| Example 5 | Ink 1 | Reaction liquid 1 | Liquid absorbing member 105a-5 | 0.14 | 2.8 |
| Example 6 | Ink 1 | Reaction liquid 2 | Liquid absorbing member 105a-5 | 0.14 | 2.4 |
| Example 7 | Ink 1 | Reaction liquid 3 | Liquid absorbing member 105a-5 | 0.14 | 3.9 |
| Example 8 | Ink 2 | Reaction liquid 1 | Liquid absorbing member 105a-5 | 0.23 | 3.3 |
| Comparative Example 1 | Ink 1 | — | Liquid absorbing member 105a-3 | 0.14 | 0.14 |
| Comparative Example 2 | Ink 3 | Reaction liquid 1 | Liquid absorbing member 105a-3 | 0.11 | 1.1 |
| Comparative Example 3 | Ink 1 | Reaction liquid 1 | Liquid absorbing member 105a-6 | 0.14 | 3.5 |
| Comparative Example 4 | Ink 4 | Reaction liquid 1 | Liquid absorbing member 105a-3 | 0.09 | 1.2 |

[Evaluation]

Evaluation was performed by the following evaluation method. The evaluation results are indicated in Table 3. In the present invention, the evaluation criteria AA to B of each of the evaluation items below were taken as preferable levels, and C was made unacceptable level.

In addition, in a case where the adhesion of the coloring material largely occurred, the smeared image was not evaluated.

<Adhesion of Coloring Material>

The extent of adhesion of the coloring material to the liquid absorbing member **105*a* after the liquid absorbing member 105*a*** was brought into contact with the first image in image formation by the transfer type ink jet recording apparatus described above was observed. It is preferable that the adhesion of coloring material is small, and evaluation criteria are as follows.

AA: No adhesion of coloring material was observed even when repeatedly used (contacting the porous body with the image 10 times)

A: No adhesion of coloring material was observed in one use

B: Although slight adhesion was observed by one use, it was a level with no problems in practical use C: Adhesion of coloring material was frequently observed by one use Regarding the reason for the evaluation result C of the adhesion of the coloring material in Comparative Example 2, the inventors of the present invention presumes that the resin fine particles that were not agglomerated by the reaction liquid were contained in the ink, and thus a cohesive force of the agglomerate of the formed coloring material and the resin fine particle was not sufficient. In addition, regarding the reason for the evaluation result C of the adhesion of the coloring material in Comparative Example 4, the inventors of the present invention presumes that the resin fine particles were not contained in the ink, and thus a cohesive force of the agglomerate of only the formed coloring materials was not sufficient.

<Smeared Image>

In the Image Formation by the Above-Described Transfer Type Ink Jet Recording apparatus, the movement amount of the coloring material at the end of the image after liquid removal, that is, the smeared image was observed. The smaller the movement amount, the higher the image quality is, the more preferable. In Comparative Examples 1 to 4, the adhesion of the coloring material was frequently observed, and thus the smeared image was not evaluated. Evaluation criteria are described below.

A: No smeared image was observed even when repeatedly used (contacting the porous body with the image 10 times)

B: Although slight smeared image was observed by one use, it was a level with no problems in practical use

TABLE 3

| | Average pore diameter S of first surface of porous body of liquid absorbing member [μm] | Average particle diameter d50 (after) of solid content contained in mixture of reaction liquid and ink [μm] | Adhesion of coloring material | Smeared image |
|---|---|---|---|---|
| Example 1 | 2 | 2.8 | B | A |
| Example 2 | 1 | 2.8 | B | A |
| Example 3 | 0.4 | 2.8 | A | A |
| Example 4 | 0.1 | 2.8 | A | B |
| Example 5 | 0.4 | 2.8 | AA | A |
| Example 6 | 0.4 | 2.4 | AA | A |
| Example 7 | 0.4 | 3.9 | AA | A |
| Example 8 | 0.4 | 3.3 | AA | A |
| Comparative Example 1 | 0.4 | 0.14 | C | — |
| Comparative Example 2 | 0.4 | 1.1 | C | — |
| Comparative Example 3 | 5 | 3.5 | C | — |
| Comparative Example 4 | 0.4 | 1.2 | C | — |

Evaluation was carried out by the same method as used in Example 1 with the exception that the direct drawing type ink jet recording apparatus illustrated in FIG. 2, which directly applies a reaction liquid to the recording medium and further applies ink to the recording medium was used instead of the transfer type ink jet recording apparatus illustrated in FIG. 1. In the image evaluation in the direct drawing type ink jet recording apparatus illustrated in FIG. 2, Gloria Pure White paper (product name, manufactured by Gojo Paper MFG. CO. Ltd, basis weight of 210 g/m$^2$) was used as a recording medium.

Except for the recording medium, the reaction liquid composition, the reaction liquid applying device 203, the ink composition, the ink applying device 204, the conveyance speed of the recording medium, and the liquid absorbing device 205 are the same conditions as those in the transfer type ink jet recording apparatus used in Example 1.

As a result, it was confirmed that evaluation results of the coloring material adhesion and the smeared image similar to those in Example 1 can be obtained.

According to the present invention, it is possible to provide an ink jet recording method which is capable of removing a liquid component from an image by bringing a porous body into contact with the image and suppressing adhesion of a coloring material constituting the image to the porous body While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An ink jet recording method comprising:

an image forming step of applying to an ink receiving medium an ink, which contains a coloring material and a resin fine particle, and a reaction liquid, which agglomerates the coloring material and the resin fine particle, to thereby form a first image including a liquid component, and an agglomerate of the coloring material and the resin fine particle on the ink receiving medium; and a liquid absorbing step of bringing a first surface of a porous body of a liquid absorbing member into contact with the first image on the ink receiving medium to thereby absorb at least a portion of the liquid component from the first image, wherein an average pore diameter S of the first surface of the porous body is smaller than an average particle diameter d50 of a solid content contained in a mixture of the reaction liquid and the ink.

2. The ink jet recording method according to claim 1, wherein the average particle diameter d50 of the solid content contained in the mixture of the reaction liquid and the ink is equal to or greater than five times the average pore diameter S.

3. The ink jet recording method according to claim 1, wherein an average particle diameter d50 of a solid content contained in the ink is smaller than the average pore diameter S.

4. The ink jet recording method according to claim 3, wherein the average particle diameter d50 of the solid content contained in the ink is 0.14 μm to 0.23 μm.

5. The ink jet recording method according to claim 1, wherein the porous body contains a fluororesin.

6. The ink jet recording method according to claim 1, wherein the ink receiving medium is a transfer body for temporarily holding the first image and a second image, which is formed when at least the portion of the liquid component is removed from the first image, and wherein the method further comprises a step of transferring the second image to a recording medium for forming a final image thereon.

7. The ink jet recording method according to claim 1, wherein the ink receiving medium is a recording medium for forming a final image thereon, and wherein a second image is formed on the recording medium when at least the portion of the liquid component is removed from the first image.

8. The ink jet recording method according to claim 1, wherein the image forming step includes, in stated order:

a step of applying the reaction liquid to the ink receiving medium; and a step of applying the ink to the ink receiving medium.

9. The ink jet recording method according to claim 1, wherein the reaction liquid contains a polyvalent metal ion or an organic acid.

10. The ink jet recording method according to claim 1, wherein the coloring material contains a pigment.

11. The ink jet recording method according to claim 1, wherein the resin fine particle is polyolefin, polystyrene, polyurethane, polyester, polyether, polyurea, polyamide, polyvinyl alcohol, poly (meth)acrylic acid, a salt of poly (meth)acrylic acid, alkyl poly (meth)acrylate, or polydiene.

12. The ink jet recording method according to claim 1, wherein the ink contains 50% by mass to 95% by mass of water with respect to a total mass of the ink.

13. The ink jet recording method according to claim 1, wherein the solid content contained in the mixture of the reaction liquid and the ink contains the agglomerate of the coloring material and the resin fine particle.

14. The ink jet recording method according to claim 1, wherein the average pore diameter S of the first surface of the porous body is 0.02 μm to 2 μm.

15. The ink jet recording method according to claim 1, wherein a shape of the porous body is a roller shape or a belt shape.

16. The ink jet recording method according to claim 1, wherein a water contact angle of the first surface of the porous body is 90° or more.

17. The ink jet recording method according to claim 1, wherein the porous body has a multilayer configuration.

18. The ink jet recording method according to claim 1, wherein the average particle diameter d50 of the solid content contained in the mixture of the reaction liquid and the ink is 2.4 μm to 3.9 μm.

19. An ink jet recording method comprising:

an image forming step of applying to an ink receiving medium an ink which contains a coloring material and a resin fine particle, and a reaction liquid which agglomerates the coloring material and the resin fine particle to thereby form a first image including a liquid component, and an agglomerate of the coloring material and the resin fine particle on the ink receiving medium; and a liquid absorbing step of bringing a first surface of a porous body of a liquid absorbing member into contact with the first image on the ink receiving medium to thereby concentrate the ink constituting the first image, wherein an average pore diameter S of the first surface of the porous body is smaller than an average particle diameter d50 of a solid content contained in a mixture of the reaction liquid and the ink.

* * * * *